US011668462B1

(12) United States Patent
Benjamin et al.

(10) Patent No.: US 11,668,462 B1
(45) Date of Patent: Jun. 6, 2023

(54) METHOD OF OPERATING A COMBUSTOR WITH A VARIABLE COMBUSTION CHAMBER

(71) Applicant: General Electric Company, Schenectady, NY (US)

(72) Inventors: Michael A. Benjamin, Cincinnati, OH (US); Ravindra Shankar Ganiger, Bengaluru (IN); Hiranya Nath, Bengaluru (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/664,976

(22) Filed: May 25, 2022

(30) Foreign Application Priority Data

Feb. 7, 2022 (IN) ..... 202211006362

(51) Int. Cl.
*F23R 3/00* (2006.01)
*F23R 3/50* (2006.01)
*F23R 3/08* (2006.01)

(52) U.S. Cl.
CPC ..... *F23R 3/002* (2013.01); *F23R 3/50* (2013.01); *F23R 3/08* (2013.01); *F23R 2900/00001* (2013.01); *F23R 2900/03341* (2013.01)

(58) Field of Classification Search
CPC .... F23R 3/002; F23R 3/50; F23R 3/08; F23R 2900/00001; F23R 2900/03341
See application file for complete search history.

(56) References Cited

U.S. PATENT DOCUMENTS 3,077,073 A 2/1963 Kuhrt
3,765,171 A * 10/1973 Hagen ..... F23R 3/26 60/39.23
3,869,246 A * 3/1975 Hammond, Jr. ..... F23R 3/26 60/39.23
4,930,725 A 6/1990 Thompson et al.
5,127,221 A 7/1992 Beebe
5,207,054 A 5/1993 Rodgers et al.
6,425,240 B1 * 7/2002 Park ..... F23R 3/26 60/39.23
6,772,595 B2 8/2004 Martling et al.
6,865,892 B2 3/2005 Garrido et al.
7,389,643 B2 6/2008 Simons et al.
(Continued)

*Primary Examiner* — Gerald L Sung
*Assistant Examiner* — Rene D Ford
(74) *Attorney, Agent, or Firm* — Venable LLP; Edward A. Kmett; Michele V. Frank

(57) ABSTRACT

A method of operating a combustor of a gas turbine, the combustor including a combustor liner that defines a total combustion chamber volume, and has a primary combustion zone defining a primary volume. The combustor liner includes a movable portion that is arranged to be actuated to adjust a percentage of the primary volume with respect to the total combustion chamber volume. The method includes, at a first operating state of the gas turbine, adjusting a size of the primary volume to a first percentage of the total combustion chamber volume by actuating the movable portion to adjust the size of the primary volume, and at a second operating state of the gas turbine different from the first operating state, adjusting the size of the primary volume to a second percentage of the total combustion chamber volume by actuating the movable portion to adjust the size of the primary volume.

19 Claims, 14 Drawing Sheets

(56) References Cited

U.S. PATENT DOCUMENTS

| | | | | |
|---|---|---|---|---|
| 10,865,987 | B2 | 12/2020 | Syed et al. | |
| 2009/0019854 | A1 | 1/2009 | Simons et al. | |
| 2021/0040896 | A1* | 2/2021 | Feulner | F01D 25/34 |
| 2021/0254550 | A1 | 8/2021 | Kraft | |

* cited by examiner

METHOD OF OPERATING A COMBUSTOR WITH A VARIABLE COMBUSTION CHAMBER

CROSS REFERENCE TO RELATED APPLICATIONS

The present application claims the benefit of Indian Patent Application No. 202211006362, filed on Feb. 7, 2022, which is hereby incorporated by reference herein in its entirety.

TECHNICAL FIELD

The present disclosure relates to a combustion chamber in a gas turbine. More particularly, the present disclosure relates to a method of operating a variable convergent-divergent combustion chamber that adjusts a volume of a primary combustion zone throughout different operating states of the gas turbine.

BACKGROUND

In conventional gas turbine engines, a combustor liner is provided to define a combustion chamber. The combustion chamber generally defines a primary combustion zone at a forward end of the combustion chamber nearest to a fuel nozzle and a mixer assembly that injects a fuel and air mixture into the combustion chamber, where the fuel and air mixture is ignited and burned to form combustion gases. The combustion chamber may also include a dilution zone downstream of the primary combustion zone, where dilution air is provided through the combustor liner to quench the combustion gases. The combustion chamber may further include a secondary combustion zone where the quenched combustion gases further mix with the dilution air before flowing through a turbine nozzle into a turbine section of the gas turbine engine. Typically, the combustor liner has a fixed length and a geometry such that the various zones of the combustion chamber (e.g., primary zone, dilution zone, secondary zone) have a fixed volume for operating through all of the various operating states, such as startup, takeoff, cruise, and approach.

BRIEF DESCRIPTION OF THE DRAWINGS

Features, advantages, and embodiments of the present disclosure will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
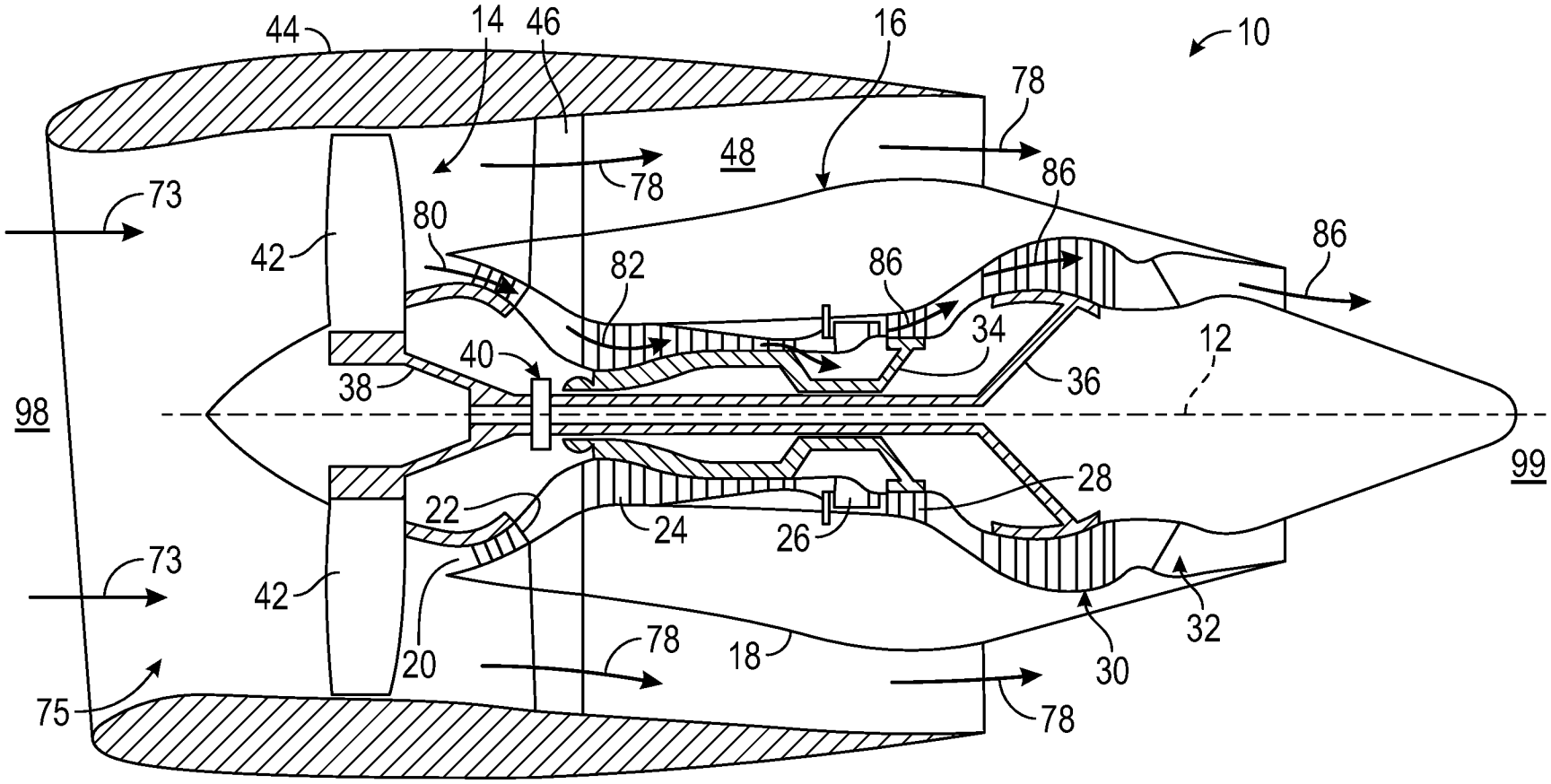
FIG. 1 is a schematic partial cross-sectional side view of an exemplary high by-pass turbofan jet engine, according to an embodiment of the present disclosure.

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Various features, advantages, and embodiments of the present disclosure are set forth or apparent from consideration of the following detailed description, drawings, and claims. Moreover, it is to be understood that the following detailed description is exemplary and intended to provide further explanation without limiting the scope of the disclosure as claimed.

In conventional gas turbine engines, the combustor liner has a fixed length and a geometry such that the various zones of the combustion chamber (e.g., primary zone, dilution zone, secondary zone) have a fixed volume for operating through all of the various operating states, such as startup, takeoff, cruise and approach. However, due to ever more stringent emission requirements for gas turbine engines, there is a need to continue to reduce NOx emissions and to obtain a more efficient burn of the fuel and air mixture. The present disclosure aims to reduce the NOx emissions and to improve operability by reducing the overall length of the combustion chamber and adjusting the volume of the primary combustion zone throughout the various operating states. According to the present disclosure, a combustor liner includes a translatable converging-diverging section in the dilution zone. The converging-diverging section can be translated by an actuator in both the upstream direction and the downstream direction based on power changes throughout the various operating states so as to adjust the volume of the primary combustion zone. For example, during ground startup, the converging-diverging section may be actuated to adjust the size of the primary combustion zone to be set to a first percentage of the overall total combustion chamber volume. Then, during takeoff and climb out, where the power requirements are increased, the converging-diverging section is actuated to adjust the primary combustion zone volume to a second percentage, which may be less than the first percentage, so as to make the primary combustion zone smaller. Thus, the smaller primary combustion zone during the high power operations can provide for a more efficient burn of the fuel and air mixture in the primary combustion zone, while, at the same time, increasing the secondary volume downstream to provide for a longer period of mixing of the combustion gases with dilution air. As a result, the operability and the efficiency of the combustor can be increased, and the emissions can be reduced.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has an axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section having a booster or low pressure (LP) compressor 22 and a high pressure (HP) compressor 24, a combustor 26, a turbine section including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive configuration or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to, and that extend radially outwardly from, the fan shaft 38. An annular fan casing, or nacelle 44, circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16, so as to define a bypass airflow passage 48 therebetween.

Figure 2:
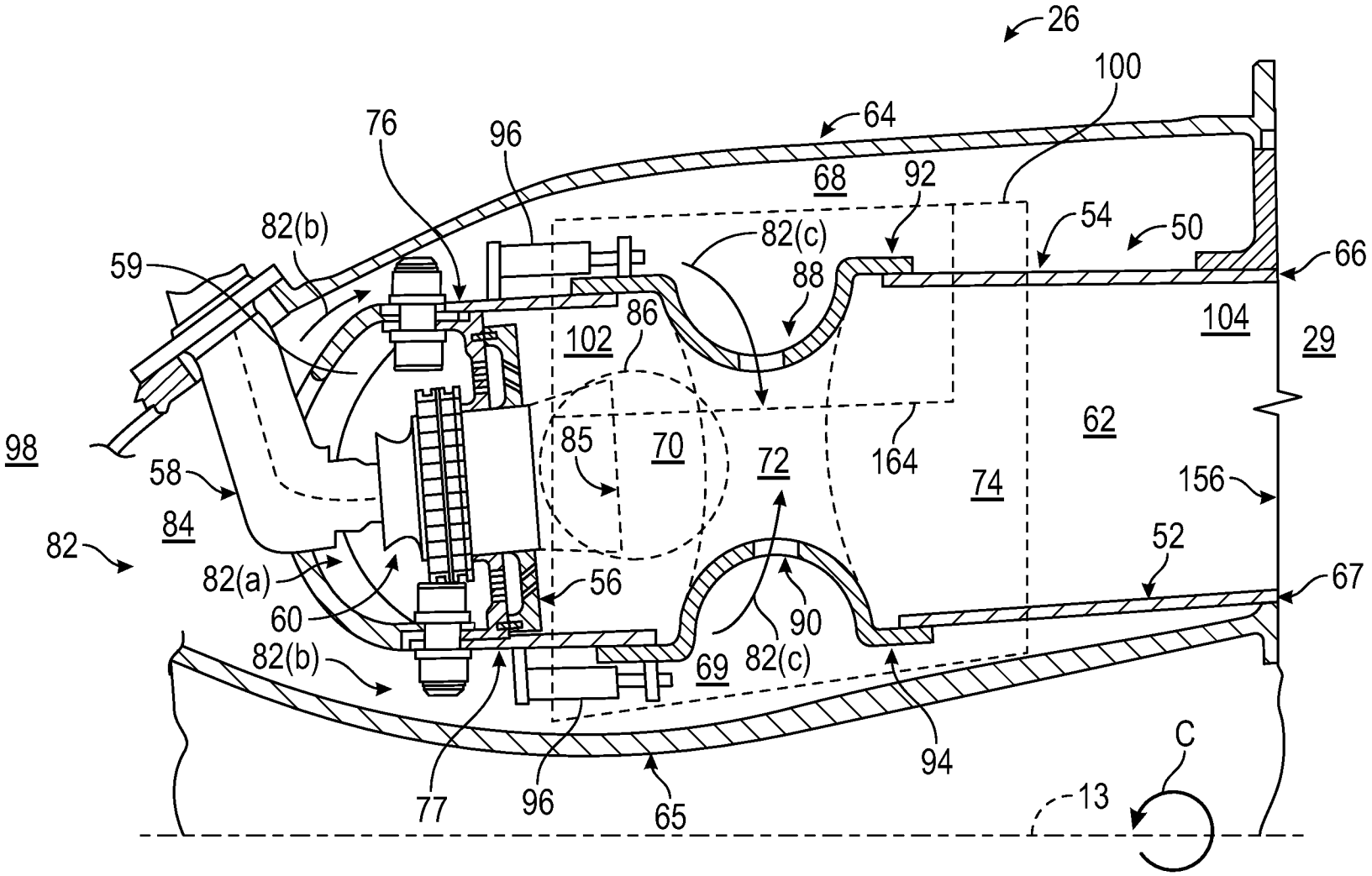
FIG. 2 is a cross-sectional side view of an exemplary combustion section, according to an embodiment of the present disclosure.

FIG. 2 is a cross-sectional side view of an exemplary combustor 26 of the core engine 16 as shown in FIG. 1. As shown in FIG. 2, the combustor 26 may generally include an annular type combustor liner 50 that extends circumferentially about a combustor centerline 13, and includes an inner liner 52 and an outer liner 54, and a dome assembly 56. Together, the inner liner 52, the outer liner 54, and the dome assembly 56 define a combustion chamber 62 therebetween. The combustion chamber 62 may more specifically define various regions, including a primary combustion zone 70 at an upstream end 102 of the combustion chamber 62, at which initial chemical reaction of a fuel-oxidizer mixture 85 and/or recirculation of combustion gases 86 may occur before flowing further downstream to a dilution zone 72, where mixture and/or recirculation of the combustion gases 86 and air may occur before flowing to a secondary combustion zone 74 at a downstream end 104 of the combustion chamber 62, where the combustion products flow into a turbine nozzle 29. The dome assembly 56 extends radially between an upstream end 76 of the outer liner 54 and an upstream end 77 of the inner liner 52.

As shown in FIG. 2, the outer liner 54 may be encased within an outer casing 64 and the inner liner 52 may be encased within an inner casing 65. An outer flow passage 68 is defined between the outer casing 64 and the outer liner 54, and an inner flow passage 69 is defined between the inner casing 65 and the inner liner 52. The inner liner 52 may extend from the upstream end 77 at the dome assembly 56 to a downstream end 67 of the inner liner 52 at the turbine nozzle 29. The outer liner 54 may extend from the upstream end 76 at the dome assembly 56 to a downstream end 66 of the outer liner 54 at the turbine nozzle 29. The outer liner 54 and the inner liner 52, therefore, at least partially define a hot gas path between the combustor liner 50 and the turbine nozzle 29.

As further seen in FIG. 2, the inner liner 52 may include a plurality of dilution openings 90 and the outer liner 54 may include a plurality of dilution openings 88. As will be described in more detail below, the dilution openings 88 and the dilution openings 90 provide a flow of compressed air 82(*c*) therethrough and into the combustion chamber 62. The flow of compressed air 82(*c*), which is a dilution air flow, can thus be utilized to provide quenching of the combustion gases 86 in the dilution zone 72 downstream of the primary combustion zone 70 so as to cool the flow of combustion gases 86 entering the turbine nozzle 29.

During operation of the engine 10, as shown in FIGS. 1 and 2 collectively, a volume of air 73, as indicated schematically by arrows, enters the engine 10 from the upstream end 98 through an associated inlet 75 of the nacelle 44 and/or fan assembly 14. As the volume of air 73 passes across the fan blades 42, a portion of the air, as indicated schematically by arrows 78, is directed or routed into a bypass airflow passage 48, while another portion of the air, as indicated schematically by an arrow 80, is directed or routed into the LP compressor 22 via the annular inlet 20. Air portion 80 entering the annular inlet 20 is progressively compressed as it flows through the LP compressor 22 and the HP compressor 24 towards the combustor 26. As shown in FIG. 2, the now compressed air, as indicated schematically by arrow 82, flows into a diffuser cavity 84 of the combustor 26.

The compressed air 82 pressurizes the diffuser cavity 84. A first portion of the compressed air 82, as indicated schematically by arrows 82(*a*), flows from the diffuser cavity 84 into a pressure plenum 59. The compressed air 82(*a*) is then swirled by a mixer assembly 60 and mixed with fuel provided by a fuel nozzle assembly 58 to generate the swirled fuel-oxidizer mixture 85 that is then ignited and burned to generate the combustion gases 86 within the primary combustion zone 70 of the combustor liner 50. Typically, the LP compressor 22 and the HP compressor 24 provide more compressed air 82 to the diffuser cavity 84 than is needed for combustion. Therefore, a second portion of the compressed air 82, as indicated schematically by arrows 82(*b*), may be used for various purposes other than combustion. For example, as shown in FIG. 2, compressed air 82(*b*) may be routed into the outer flow passage 68 and into the inner flow passage 69. A portion of the compressed air 82(*b*) may then be routed through the dilution opening 88 (schematically shown as compressed air 82(*c*)) and into the dilution zone 72 of the combustion chamber 62 to provide quenching of the combustion gases 86 in the dilution zone 72, and may also provide turbulence to the flow of combustion gases 86 so as to provide better mixing of the compressed air 82(*c*) with the combustion gases 86. A similar flow of the compressed air 82(*c*) from the inner flow passage 69 flows through the dilution opening 90 and into the dilution zone 72. In addition, or in the alternative, at least a portion of compressed air 82(*b*) may be routed out of the diffuser cavity 84 and may be directed through various flow passages (not shown) to provide cooling air to at least one of the HP turbine 28 or the LP turbine 30.

Referring back to FIGS. 1 and 2 collectively, the combustion gases 86 generated in the combustion chamber 62 flow from the combustor liner 50 into the HP turbine 28 via the turbine nozzle 29, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsion at the downstream end 99.

As will be described in more detail below, the combustor liner 50 includes an outer liner converging-diverging section 92 and an inner liner converging-diverging section 94. Both the outer liner converging-diverging section 92 and the inner liner converging-diverging section 94 extend into the dilution zone 72 of the combustion chamber 62. The dilution openings 88 are seen to extend through the outer liner converging-diverging section 92 and the dilution openings 90 are seen to extend through the inner liner converging-diverging section 94. In addition, both the outer liner converging-diverging section 92 and the inner liner converging-diverging section 94 are connected to a respective actuator 96. The respective actuators 96 drive the outer liner converging-diverging section 92 and the inner liner converging-diverging section 94 in upstream and downstream directions (i.e., upstream toward the upstream ends 76, 77, or downstream toward the downstream ends 66, 67). As a result, a size (volume) of the primary combustion zone 70 and the secondary combustion zone 74 can be adjusted by shifting the converging-diverging sections 92, 94.

Figure 3:
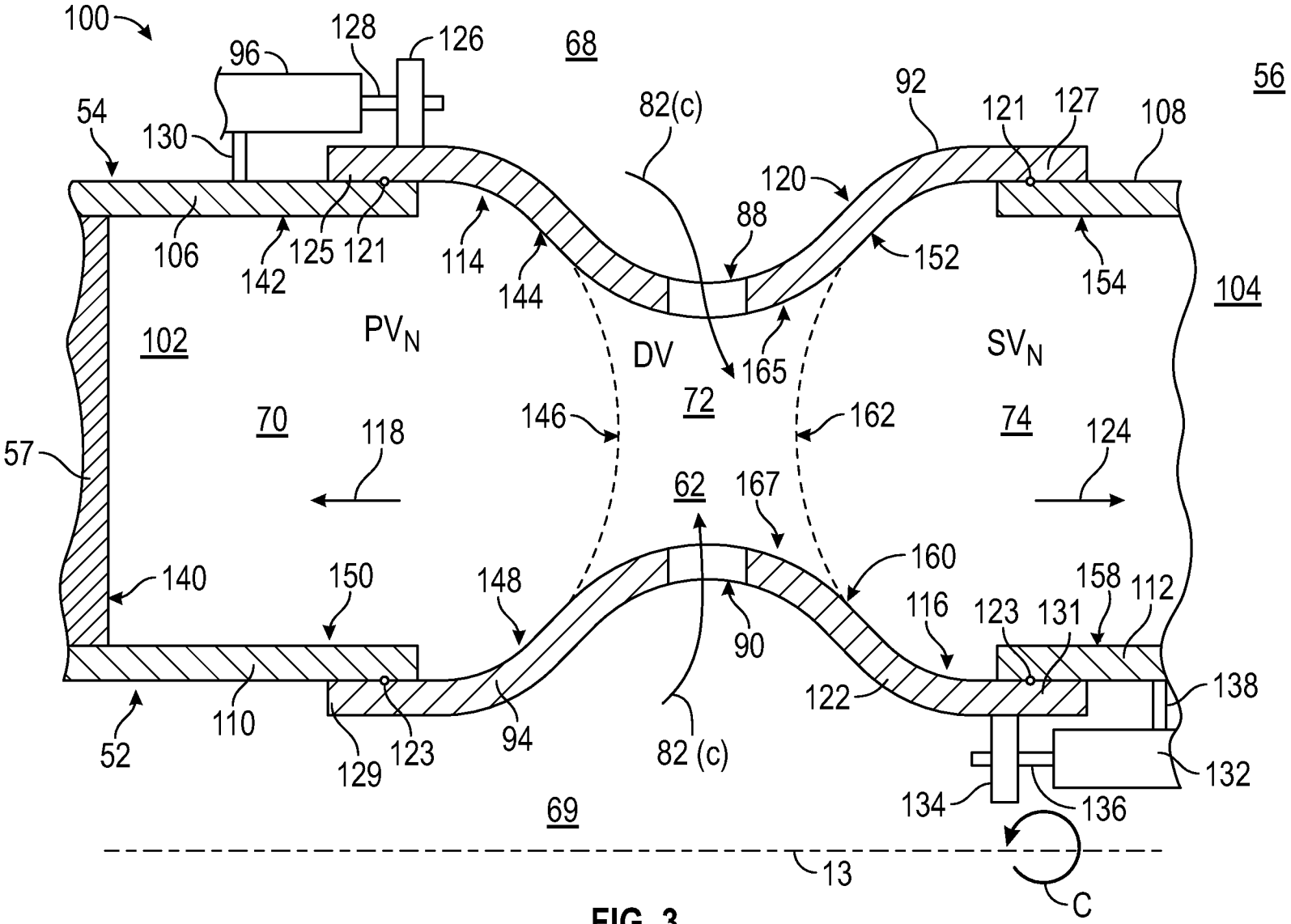
FIG. 3 is a partial cross-sectional side view of a combustor liner and a converging-diverging section taken at detail view 100 of FIG. 2, according to an aspect of the present disclosure.

FIG. 3 is a partial cross-sectional side view of a combustor liner and a converging-diverging section taken at detail view 100 of FIG. 2, according to an aspect of the present disclosure. In FIG. 3, a configuration is depicted in which the outer liner 54 and the inner liner 52 are two-part liners, and the converging-diverging sections 92, 94 connect the separate liner parts. More specifically, the outer liner 54 is seen to include an upstream liner section 106 and a downstream liner section 108. Both the upstream liner section 106 and the downstream liner section 108 are fixedly connected within the combustor 26 with a gap 114 therebetween. The upstream liner section 106 and the downstream liner section 108, along with the gap 114, extend circumferentially about the combustor centerline 13. Similarly, the inner liner 52 includes an upstream liner section 110 and a downstream liner section 112, both of which are also fixedly connected within the combustor 26 with a gap 116 therebetween. Extending across the gap 114 is a dilution liner section 120, which, in the aspect of FIG. 3, constitutes the outer liner converging-diverging section 92. The entirety of the dilution liner section 120 constitutes the movable portion and an upstream end 125 of the dilution liner section 120 slidingly engages with the upstream liner section 106, and a downstream end 127 of the dilution liner section 120 slidingly engages with the downstream liner section 108. A seal 121 may be provided between the upstream end 125 of the dilution liner section 120 and the upstream liner section 106, and may also be provided between the downstream end 127 of the dilution liner section 120 and the downstream liner section 108. Similarly, extending across the gap 116 is a dilution liner section 122, which constitutes the inner liner converging-diverging section 94. The entirety of the dilution liner section 122 constitutes the movable portion and an upstream end 129 of the dilution liner section 122 slidingly engages with the upstream liner section 110, and a downstream end 131 of the dilution liner section 122 slidingly engages with the downstream liner section 112. A seal 123 may be provided between the upstream end 129 of the dilution liner section 122 and the upstream liner section 110, and may also be provided between the downstream end 131 of the dilution liner section 122 and the downstream liner section 112. Other arrangements for the dilution liner section 120 and the dilution liner section 122 will be described below.

The dilution liner section 120 is a movable portion that translates in an upstream direction 118 and a downstream direction 124. The translation is controlled by the actuator 96 that is connected to an actuator connecting member 126 of the dilution liner section 120. Of course, a plurality of actuators 96 may be provided in the combustor 26 and may be circumferentially spaced apart about the combustor centerline 13. The actuator 96 may be, for example, a pneumatic actuator or a hydraulic actuator that extends/retracts a linkage 128 attached to the actuator connecting member 126. The actuator 96 may be fixedly mounted to the upstream liner section 106 via an actuator support member 130, or may be mounted to the outer casing 64 (FIG. 2), for example. Similarly, the dilution liner section 122 is a movable portion that translates in the upstream direction 118 and translates in the downstream direction 124. The translation is controlled by an actuator 132 that is connected to an actuator connecting member 134 of the dilution liner section 122 via a linkage 136. The actuator 132 may be of the same construction as the actuator 96 (i.e., the same pneumatic or hydraulic actuator) and may be fixedly mounted to the downstream liner section 112 via a support member 138, or may be mounted to the inner casing 65 (FIG. 2). The actuator 96 is shown as being connected to an upstream side of the dilution liner section 120, but it may instead be connected to a downstream side of the dilution liner section 120, similar to the actuator 132. Likewise, while the actuator 132 is shown as being connected to a downstream side of the dilution liner section 122, it may instead be connected to the upstream side of the dilution liner section 122, similar to the actuator 96.

In operation, the dilution liner section 120 and the dilution liner section 122, or as will be described below, a movable portion of the dilution liner section 120 and a movable portion of the dilution liner section 122, is actuated by the actuator 96 and the actuator 132 to adjust a percentage of a primary volume (PV) (i.e., the volume of the primary combustion zone 70) with respect to a total combustion chamber volume ($V_T$) throughout various operating states of the engine 10. In FIG. 3, the primary volume (PV) may be seen to generally correspond to a volume defined by a primary area between a downstream surface 140 of the dome 57, an inner surface 142 of the outer liner upstream liner section 106, an upstream surface 144 of the dilution liner section 120, a primary volume boundary line 146 extending across the combustion chamber 62, an upstream surface 148 of the inner liner dilution liner section 122, and an inner surface 150 of the inner liner upstream liner section 110, with the area then taken circumferentially about the combustor centerline 13. Similarly, a secondary volume (SV) (i.e., the volume of the secondary combustion zone 74) may be defined by a secondary area between a downstream surface 152 of the dilution liner section 120, an inner surface 154 of the downstream liner section 108, an exit boundary line 156 (FIG. 2) of the combustion chamber 62, an inner surface 158 of the downstream liner section 112, a downstream surface 160 of the dilution liner section 122, and a secondary volume boundary line 162, with the secondary area then being taken circumferentially about the combustor centerline 13. The total volume ($V_T$) includes the primary volume (PV) and the secondary volume (SV), along with a volume of the dilution zone 72, which may be generally defined as a dilution area between the primary volume boundary line 146, an inner surface 165 in the dilution zone 72 of the dilution liner section 120, the secondary volume boundary line 162, and an inner surface 167 in the dilution zone 72 of the dilution liner section 122, with the dilution area then being taken circumferentially about the combustor centerline 13.

Figure 4:
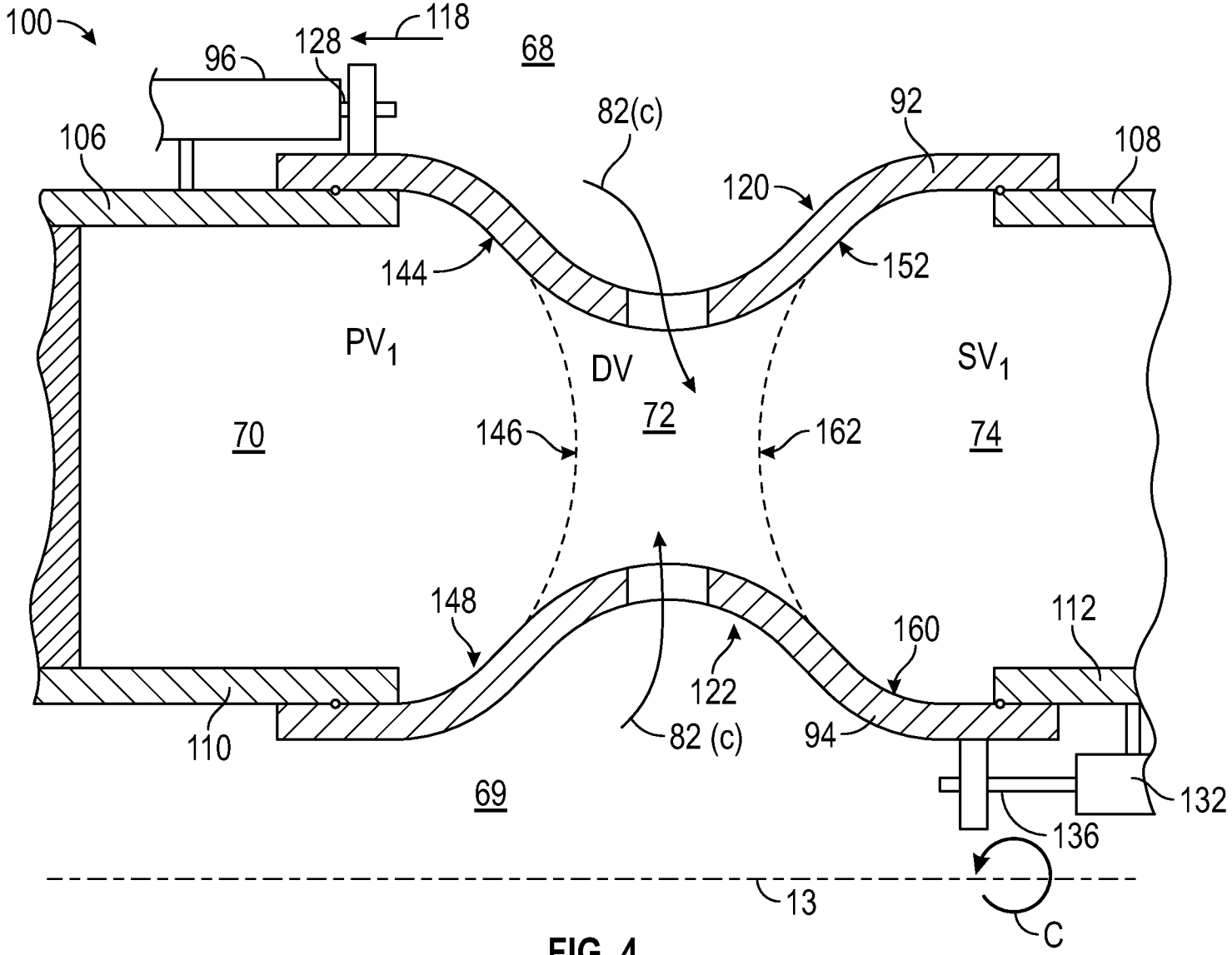
FIG. 4 is a partial cross-sectional side view of a combustor liner and a converging-diverging section taken at detail view 100 of FIG. 2, according to an aspect of the present disclosure.

In what may be considered to be a neutral position, the dilution liner section 120 and the dilution liner section 122 are actuated by their respective actuators 96 and 132 so as to define a neutral primary volume ($PV_N$) as shown in FIG. 3. The neutral primary volume ($PV_N$) may be, for example, forty percent of the total combustor volume $V_T$. Then, during operation, at a first operating state of the engine 10, such as during ground start-up of the engine 10, a size of the primary volume (PV) is adjusted by actuating the actuator 96 and the actuator 132 to translate the dilution liner section 120 and the dilution liner section 122 either in the upstream direction 118 or the downstream direction 124 to set the primary volume to a first percentage of the total volume ($V_T$). For example, as seen in FIG. 4, the actuator 96 is actuated so as to retract the linkage 128 in order to translate the dilution liner section 120 in the upstream direction 118, and the actuator 132 is actuated to extend the linkage 136 so as to translate the dilution liner section 122 in the upstream direction 118. In this case, the primary volume ($PV_N$) is decreased so as to define a smaller primary volume ($PV_1$). The primary volume ($PV_1$) is decreased mechanically or structurally by the shifting of the upstream surface 144 of the dilution liner section 120 in the upstream direction 118 and by shifting the upstream surface 148 of the dilution liner section 122 in the upstream direction 118. The primary volume ($PV_1$) is also decreased aerodynamically by shifting the dilution opening 88 and the dilution opening 90 in the upstream direction 118, which shifts the compressed air 82(*c*) in the upstream direction 118 so as to shift the primary volume boundary line 146 in the upstream direction 118. In the same manner, the size of the secondary volume is increased from the secondary volume ($SV_N$) to a greater volume ($SV_1$). Thus, as one example, the first percentage of the primary volume (PV) during the ground start may be set to have a range from forty percent to sixty percent of the total volume ($V_T$). Alternatively, the first operating state may be considered to be an altitude relight state, and the actuator 96 and the actuator 132 may be controlled to set the primary volume to have a range from forty percent to seventy percent of the total volume ($V_T$).

Figure 5:
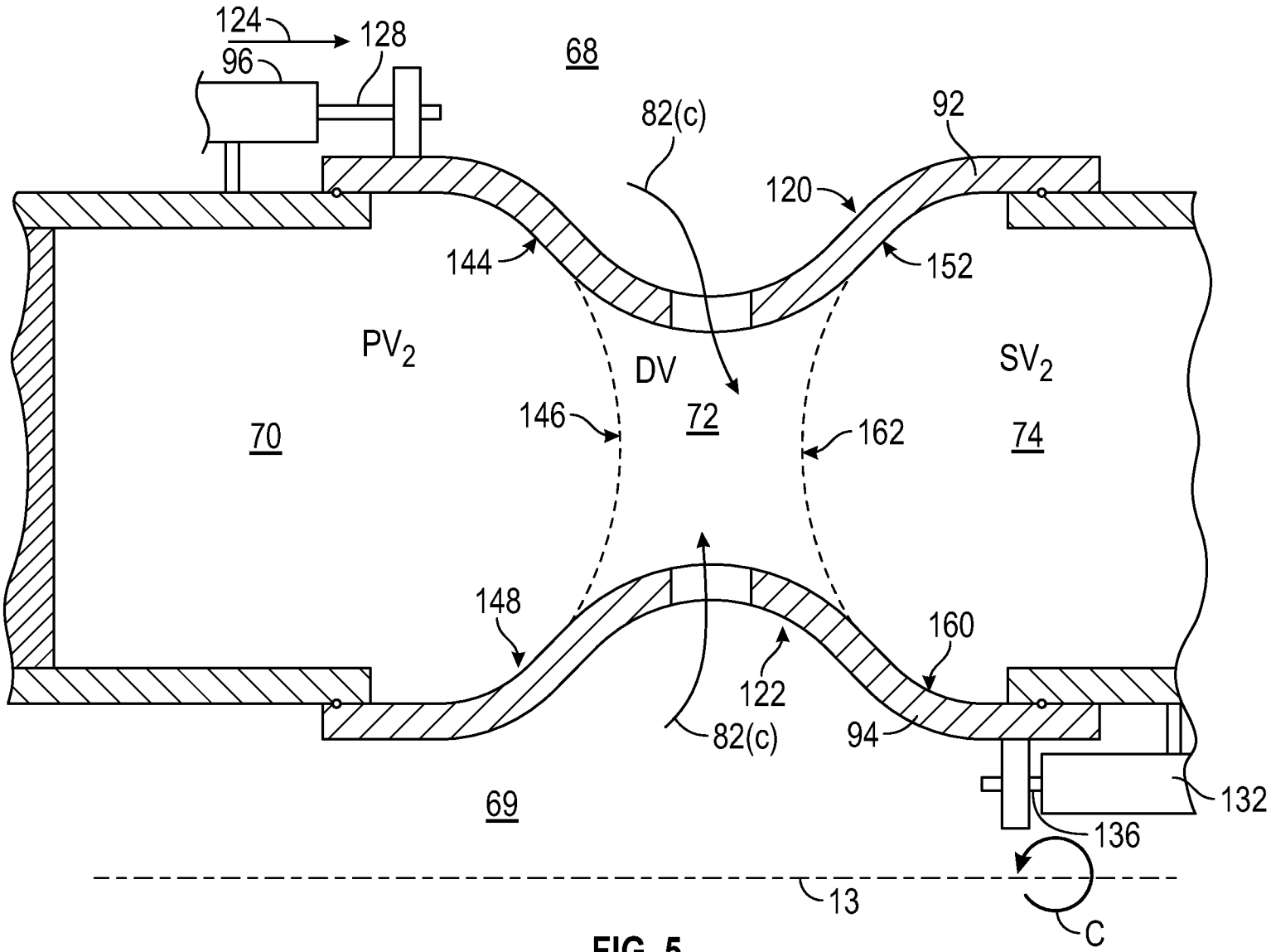
FIG. 5 is a partial cross-sectional side view of a combustor liner and a converging-diverging section taken at detail view 100 of FIG. 2, according to an aspect of the present disclosure.

Alternatively, as seen in FIG. 5, the actuator 96 is actuated so as to extend the linkage 128 in order to translate the dilution liner section 120 in the downstream direction 124, and the actuator 132 is actuated to retract the linkage 136 so as to translate the dilution liner section 122 in the downstream direction 124. In this case, the primary volume ($PV_N$) is increased so as to define a greater primary volume ($PV_2$). The primary volume ($PV_2$) is increased mechanically or structurally by the shifting of the upstream surface 144 of the dilution liner section 120 in the downstream direction 124 and by shifting the upstream surface 148 of the dilution liner section 122 in the downstream direction 124. The primary volume ($PV_2$) is also increased aerodynamically by shifting the dilution opening 88 and the dilution opening 90 in the downstream direction 124, which shifts the flow of the compressed air 82(*c*) in the downstream direction 124 so as to shift the primary volume boundary line 146 in the downstream direction 124. In the same manner, the size of the secondary volume (SV) is decreased from the secondary volume ($SV_N$) to a smaller volume ($SV_2$).

Continuing with various operation states of the engine 10 (FIG. 1), when the primary volume (PV) has been set based on the first operating state being a ground start-up, for example, at a second operating state of the gas turbine different from the first operating state, such as during a takeoff operation or a climb operation, the actuator 96 and the actuator 132 are controlled to translate the dilution liner section 120 and the dilution liner section 122 in either the upstream direction 118 or the downstream direction 124 so as to set the primary volume (PV) to a second percentage of the total volume ($V_T$), where the second percentage may have a range from thirty percent to forty percent of the total volume ($V_T$). Thus, by reducing the size of the primary volume during takeoff or climb when the combustion gases may be hotter due to the higher power applied to the engine, the hotter gases can be quenched quickly and effectively, thereby reducing the NOx emissions.

In another example, at a third operating state of the gas turbine different from the first operating state (ground startup or altitude relight) and the second operating state (takeoff or climb), such as a cruise operating state, the actuator 96 and the actuator 132 can be controlled so as to adjust the size of the primary volume (PV) to a third percentage of the total volume ($V_T$). The third percentage for the cruise operating state may have a range from thirty percent to fifty percent of the total volume ($V_T$). Further, at a fourth operating state of the gas turbine different from the first operating state (ground startup or altitude relight), the second operating state (takeoff or climb), and the third operating state (cruise), such as during a landing approach operating state, the actuator 96 and the actuator 132 are controlled to adjust the size of the primary volume (PV) to a fourth percentage of the total volume ($V_T$). The fourth percentage for the landing approach operating state may have a range from thirty percent to fifty percent of the total volume ($V_T$).

Figure 6:
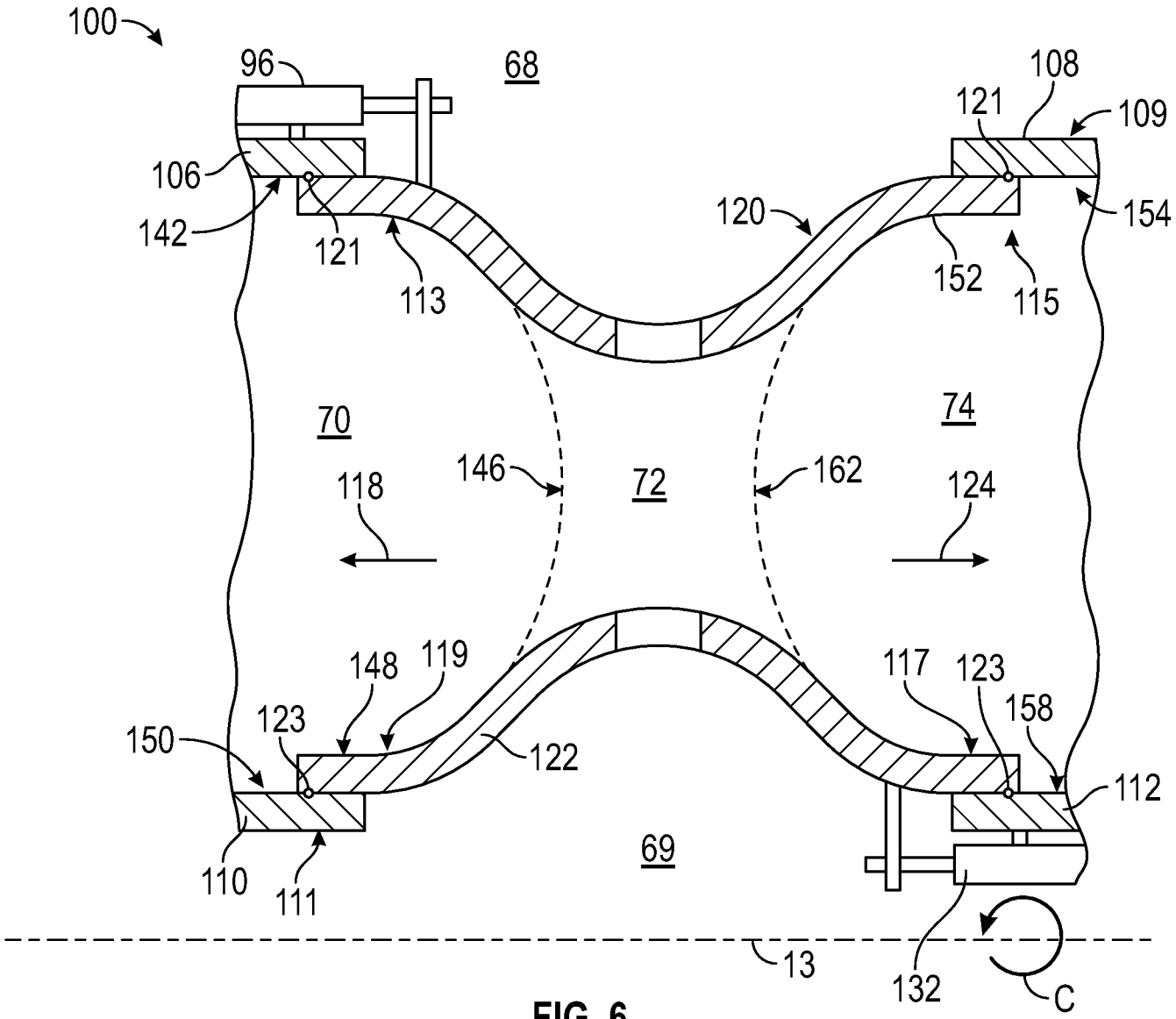
FIG. 6 is a partial cross-sectional side view of a combustor liner and a converging-diverging section taken at detail view 100 of FIG. 2, according to another aspect of the present disclosure.

Various alternative arrangements of the dilution liner section will now be described with regard to FIGS. 6 to 13. FIG. 6 is a partial cross-sectional side view of a combustor liner and a converging-diverging section taken at detail view 100 of FIG. 2, according to another aspect of the present disclosure. The FIG. 6 arrangement is similar to that of FIG. 3 in that the dilution liner section 120 and the dilution liner section 122 are both a movable portion as a whole. However, in the FIG. 6 arrangement, the dilution liner section 120 is seen to be arranged to engage with the inner surface 142 of the upstream liner section 106 and with the inner surface 154 of the downstream liner section 108. Similarly, the dilution liner section 122 is seen to be arranged to engage with the inner surface 150 of the upstream liner section 110 and with the inner surface 158 of the downstream liner section 112. The dilution liner section 120 can be translated in the upstream direction 118 and in the downstream direction 124 by the actuator 96 in the same manner as described above with regard to FIGS. 3 to 5. Similarly, the dilution liner section 122 can be translated in the upstream direction 118 and in the downstream direction 124 by the actuator 132 in the same manner as described above with regard to FIGS. 3 to 5. Although not shown in FIG. 6, an arrangement can be implemented in which an upstream end 113 of the dilution liner section 120 engages with the inner surface 142 of the upstream liner section 106 as shown in FIG. 6, but, at a downstream end 115 of the dilution liner section 120, the downstream surface 152 of the dilution liner section 120 engages with an outer surface 109 of the downstream liner section 108. Similarly, a downstream end 117 of the dilution liner section 122 may engage with the inner surface 158 of the downstream liner section 112 as shown in FIG. 6, but, at an upstream end 119 of the dilution liner section 122, the upstream surface 148 of the dilution liner section 122 may engage with an outer surface 111 of the upstream liner section 110.

Figure 7:
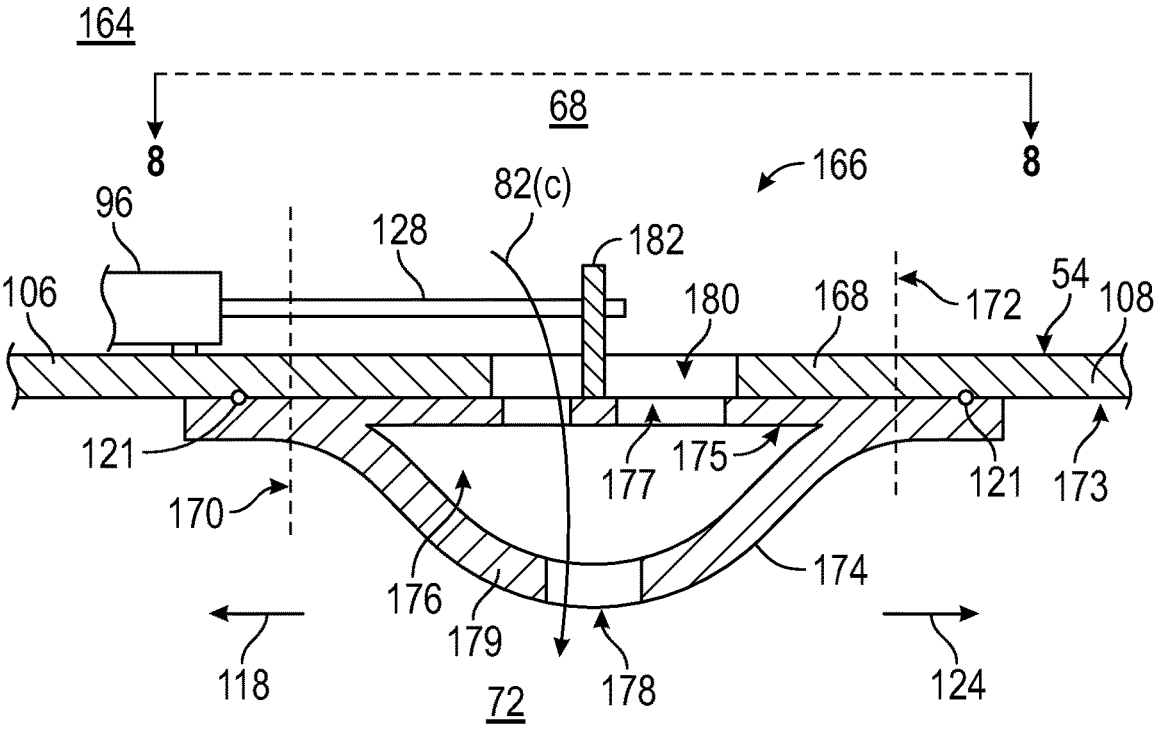
FIG. 7 is a partial cross-sectional side view of a combustor liner and a dilution liner section taken at detail view 164 of FIG. 2, according to yet another aspect of the present disclosure.

FIG. 7 is a partial cross-sectional side view of a combustor liner and a dilution liner section taken at detail view 164 of FIG. 2, according to yet another aspect of the present disclosure. In FIGS. 3 to 6, views taken at detail view 100 depict arrangements for both the outer liner 54 side of the dilution liner section 120 and the inner liner 52 side of the dilution liner section 122. The depiction of both the outer liner 54 side and the inner liner 52 side is provided to describe how the primary volume is adjusted by both sides acting in conjunction with one another. In the description that follows for FIGS. 7 to 13, only the dilution liner section for one side (the outer liner 54 side) will be described, but it should be understood that each arrangement described below can be applied equally on the inner liner 52 side of the combustor liner 50.

Figure 8:
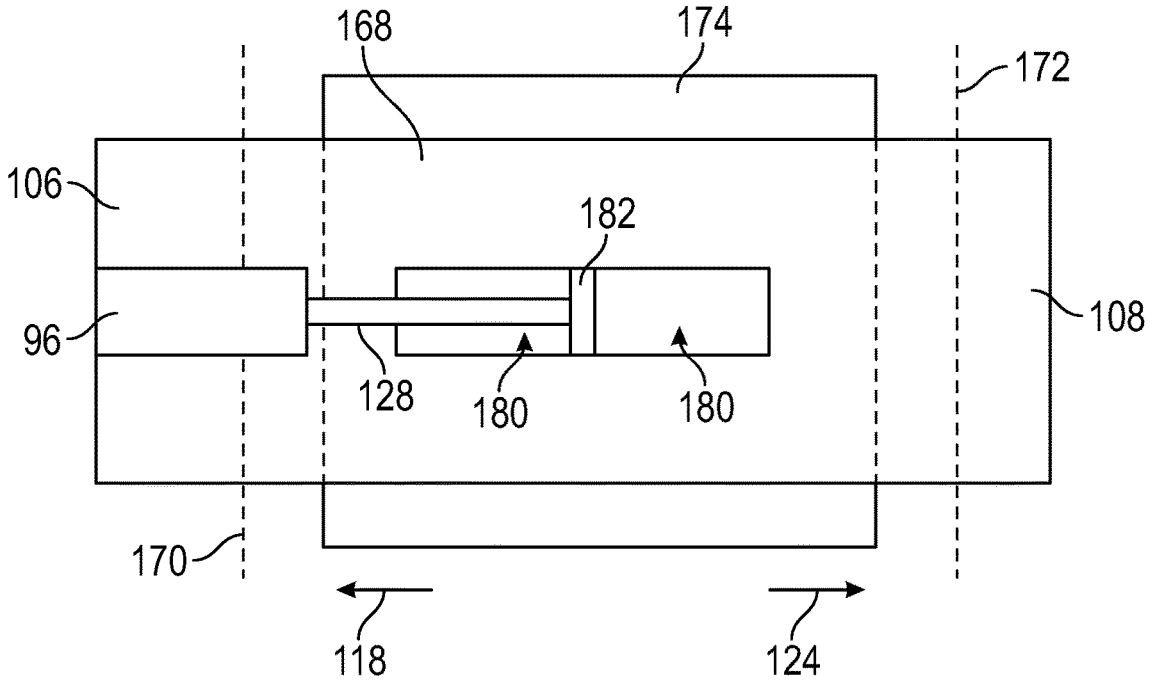
FIG. 8 is a top view of a portion of the dilution liner section taken at view 8-8 of FIG. 7, according to an aspect of the present disclosure.

FIG. 7 depicts an arrangement of a dilution liner section 166 that may be implemented as a box slider arrangement. In contrast to the arrangement in FIG. 4, in which the outer liner 54 is implemented as a two-piece liner (i.e., the upstream liner section 106 and the downstream liner section 108 with the gap 114 therebetween), the outer liner 54 of FIG. 7 is implemented as a single liner without the gap 114. Thus, the upstream liner section 106 and the downstream liner section 108 are connected with a dilution liner 168, which is a fixed portion of the dilution liner section 166. A boundary line 170 represents a connection between the upstream liner section 106 and the dilution liner 168, and a boundary line 172 represents a connection between the downstream liner section 108 and the dilution liner 168. The dilution liner section 166 further includes a box slider 174, which may also be referred to as a movable portion of the dilution liner section 166. The box slider 174 may be implemented as a converging-diverging member 179, similar to the dilution liner section 120, that extends into the combustion chamber 62. The box slider 174 may include a cross-member 175 that forms a cavity 176 therewithin. The cross-member 175 has an opening 177 therethrough and the converging-diverging member 179 includes at least one dilution opening 178 extending through the box slider 174. The dilution opening 178 may be similar to the dilution opening 88 of the dilution liner section 120. The dilution liner 168 is seen to include a slotted opening 180 therethrough. FIG. 8, which is a top view of a portion of the dilution liner section 166 taken at view 8-8 of FIG. 7, depicts an example of the slotted opening 180 extending through the dilution liner 168. Thus, compressed air 82(*c*) can pass through the slotted opening 180 and into the cavity 176 via the opening 177, and then into the dilution zone 72 through the dilution opening 178 of the converging-diverging member 179.

The box slider 174 also includes an actuator connecting member 182 that is connected with the cross-member 175. The linkage 128 of the actuator 96 is connected with the actuator connecting member 182 so as to translate the box slider 174 in the upstream direction 118 and in the downstream direction 124. The cross-member 175 slidingly engages with an inner surface 173 of the upstream liner section 106, the downstream liner section 108, and the dilution liner 168. The primary volume (PV) is thus adjusted in a similar manner as described above by the actuation of the box slider 174 in both the upstream direction 118 and in the downstream direction 124.

Figure 9:
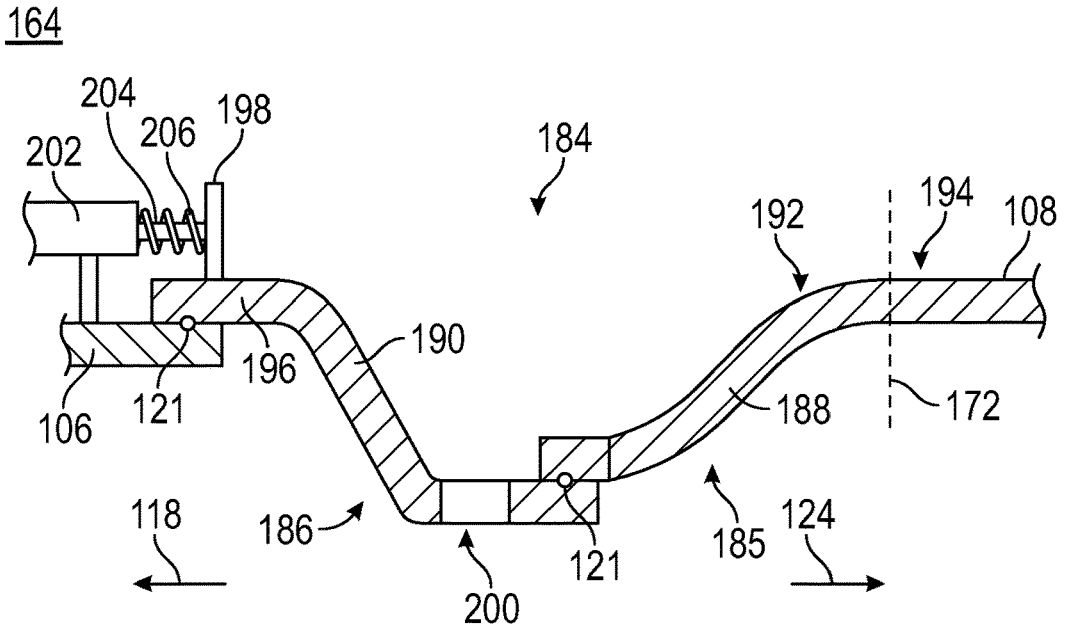
FIG. 9 is a partial cross-sectional side view of a combustor liner and a dilution liner section taken at detail view 164 of FIG. 2, according to yet another aspect of the present disclosure.

FIG. 9 is a partial cross-sectional side view of a combustor liner and a converging-diverging section taken at detail view 164 of FIG. 2, according to still another aspect of the present disclosure. In FIG. 9, a converging-diverging portion 185 of a dilution liner section 184 may be arranged as a split unit. The dilution liner section 184 includes a fixed portion 192 comprising a diverging portion 188 connected at an upstream end 194 of the downstream liner section 108 and extending into the combustion chamber 62. The diverging portion 188 is fixed to the downstream liner section 108 and may be formed integral with the downstream liner section 108. The dilution liner section 184 also includes a movable portion 186 that includes a converging portion 190 extending into the combustion chamber 62. The converging portion 190 of the movable portion 186 includes a dilution opening 200 therethrough. The converging portion 190 slidingly engages with the diverging portion 188 of the fixed portion 192 of the dilution liner section 184 with the seal 121 therebetween. An upstream end 196 of the movable portion 186 slidingly engages with the upstream liner section 106 with the seal 121 therebetween.

An actuator connecting member 198 is connected to the movable portion 186 and a linkage 204 of an actuator 202 is connected with the actuator connecting member 198. The actuator 202 may be similar to the actuator 96. In the FIG. 9 aspect, however, a spring-like device 206 may be included between the actuator 202 and the actuator connecting member 198 to provide a retraction force (i.e., a first translational force) or an extension force (i.e., a second translational force) between the actuator 202 and the actuator connecting member 198. The spring-like device 206 may be, for example, a spring, a bellows, or a W-seal device. While not depicted in any of FIGS. 3 to 8, the spring-like device 206 may nonetheless be implemented in conjunction with the actuator 96 or the actuator 132. In a case when the spring-like device 206 applies a retraction force (first translational force), the actuator 202 may be actuated to increase an extension pressure in order to extend the linkage 204 so as to translate the movable portion 186 in the downstream direction 124. The extension pressure in the actuator 202 may be relieved such that the spring-like device 206 applies a second translational force to retract the linkage 204 so as to translate the movable portion 186 in the upstream direction 118. Thus, the actuator 202 can translate the converging portion 190 in the upstream direction 118 and in the downstream direction 124, but the fixed diverging portion 188 does not translate in either direction. As a result, the size of the primary volume (PV) may be adjusted by actuating the movable portion 186. The translation of the movable portion 186 also results in adjusting the volume of the dilution volume (DV), while the secondary volume (SV) remains unchanged.

Figure 10:
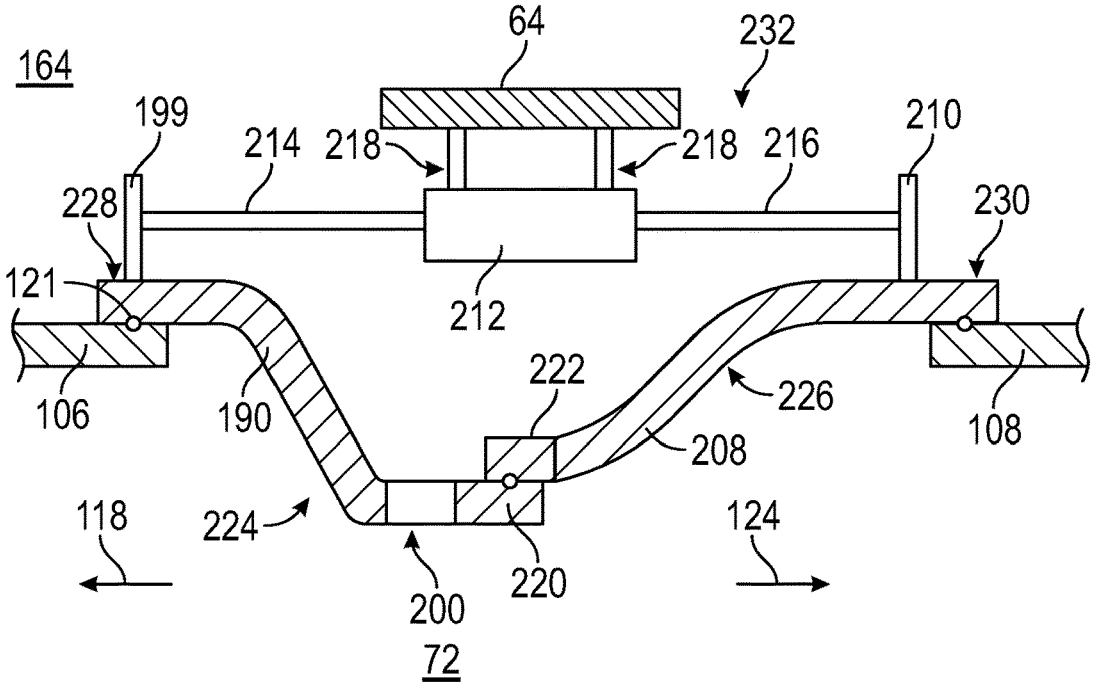
FIG. 10 is a partial cross-sectional side view of a combustor liner and a dilution liner section taken at detail view 164 of FIG. 2, according to still yet another aspect of the present disclosure.

FIG. 10 is a partial cross-sectional side view of a combustor liner and a dilution liner section taken at detail view 164 of FIG. 2, according to still another aspect of the present disclosure. The FIG. 10 arrangement depicts a dilution liner section 232 that is similar to the FIG. 9 arrangement of the dilution liner section 184 in that the dilution liner section 232 provides for a split unit. However, unlike the FIG. 9 arrangement in which the diverging portion 188 is fixed to the downstream liner section 108, the FIG. 10 arrangement includes a movable diverging portion 208. In FIG. 10, the dilution liner section 232 is seen to include an upstream portion 224 including the converging portion 190 and a first transition portion 220 downstream of the converging portion 190. A dilution opening 200 extends through the first transition portion 220. The dilution liner section 232 also includes a downstream portion 226 that includes a diverging portion 208 and a second transition portion 222 upstream of the diverging portion 208. An upstream end 228 of the upstream portion 224 slidingly engages with the upstream liner section 106, and a downstream end 230 of the downstream portion 226 slidingly engages with the downstream liner section 108. The first transition portion 220 of the upstream portion 224 and the second transition portion 222 of the downstream portion 226 slidingly engage with one another.

The upstream portion 224 includes a first actuator connecting member 199 at the upstream end 228, and the downstream portion 226 includes a second actuator connecting member 210 at the downstream end 230. An actuator 212 is seen to be connected between with the first actuator connecting member 199 via an upstream linkage 214, and the actuator 212 is connected with the second actuator connecting member 210 via a downstream linkage 216. The actuator 212 may be connected to the outer casing 64 via actuator support members 218. The actuator 212 is capable of actuating both the upstream portion 224 and the downstream portion 226 simultaneously in opposing directions, or the actuator 212 may actuate only one of either the upstream portion 224 or the downstream portion 226 individually. Thus, for example, the actuator 212 may be actuated to extend the upstream linkage 214 so as to translate the upstream portion 224 in the upstream direction 118 so as to reduce the size of the primary volume (PV), and may not actuate the downstream portion 226 so as to retain the secondary volume (SV) the same. Alternatively, the actuator 212 may be actuated to extend the upstream linkage 214 to translate the upstream portion 224 in the upstream direction 118, and also to extend the downstream linkage 216 so as to translate the downstream portion 226 in the downstream direction 124. In such a case, the size of the primary volume (PV) is reduced, and the size of the secondary volume (SV) is also reduced, while the size of the dilution volume (DV) is increased.

Figure 11:
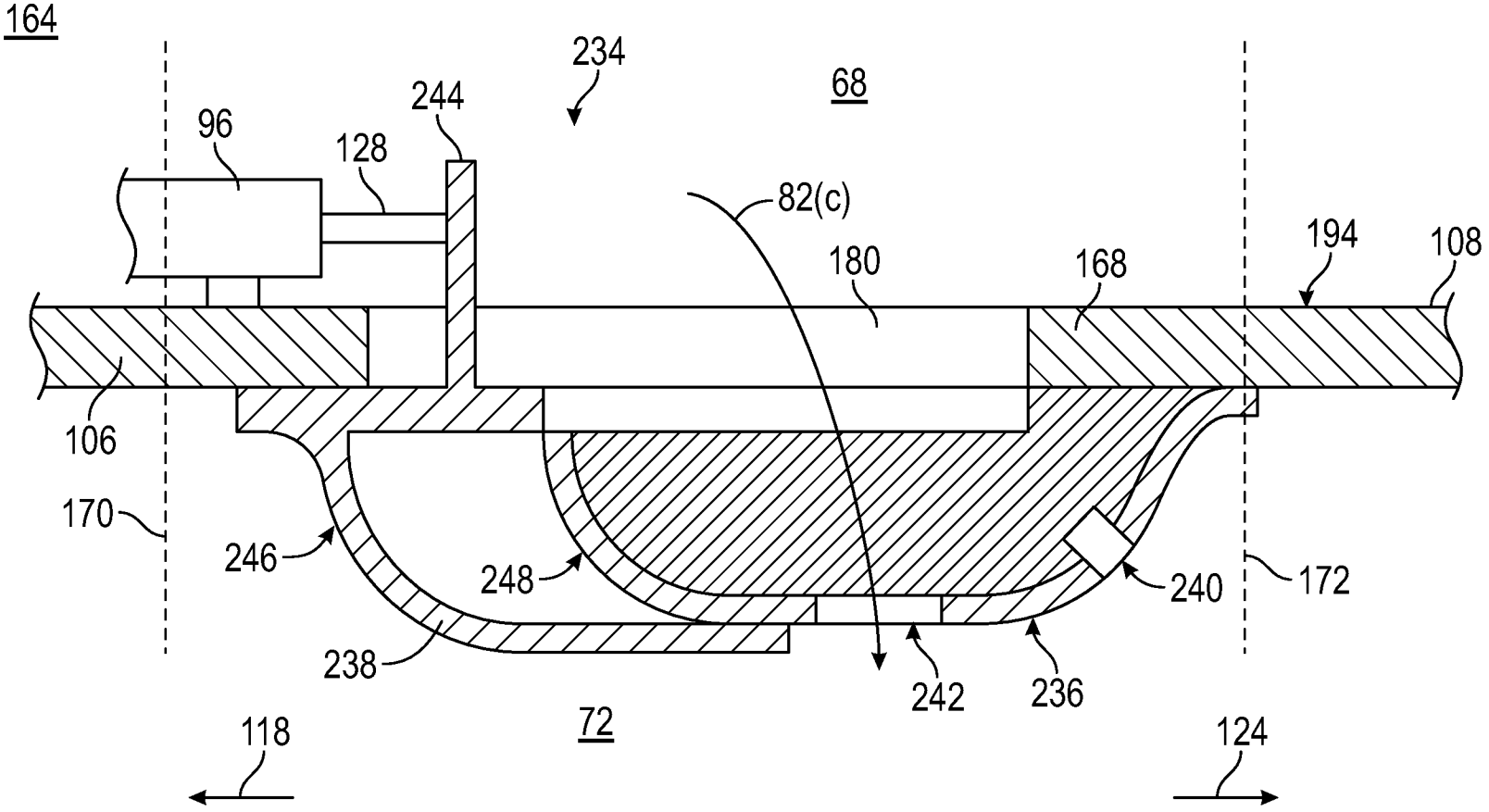
FIG. 11 is a partial cross-sectional side view of a combustor liner and a dilution liner section taken at detail view 164 of FIG. 2, according to yet another aspect of the present disclosure.

FIG. 11 is a partial cross-sectional side view of a combustor liner and a dilution liner section taken at detail view 164 of FIG. 2, according to yet another aspect of the present disclosure. In FIG. 11, a dilution liner section 234 is depicted as an arrangement that is similar to the box slider arrangement in FIG. 7. Thus, the upstream liner section 106 and the downstream liner section 108 are connected via the dilution liner 168, and the dilution liner 168 includes the slotted opening 180 therethrough.

Unlike the FIG. 7 arrangement in which the entire converging-diverging member 179 is movable, in the FIG. 11 arrangement, a converging-diverging member 236 is fixed to the dilution liner 168 and/or the downstream liner section 108, and a contoured movable portion 238 is arranged on an upstream side of the converging-diverging member 236. The converging-diverging member 236 is a generally fixed structure, and, as one example, may constitute an acoustic damper. As seen in FIG. 11, the converging-diverging member 236 is depicted as an acoustic damper that includes an acoustic damper inlet feed tube 240 on a downstream side of the converging-diverging member 236, and includes a dilution opening 242 for providing a flow of compressed air 82(*c*) therethrough into the dilution zone 72. The contoured movable portion 238 may have a contoured upstream side 246 that is shaped to generally align with a shape of an upstream side 248 of the converging-diverging member 236. The contoured movable portion 238 includes an actuator connecting member 244 attached thereto. The linkage 128 of the actuator 96 is connected with the actuator connecting member 244. Thus, in operation, the actuator can translate the contoured movable portion 238 in either the upstream direction 118 to reduce the size of the primary volume (PV), or can translate the contoured movable portion 238 in the downstream direction 124 to increase the size of the primary volume (PV). By implementing the fixed converging-diverging member 236 in the FIG. 11 arrangement, the second volume (SV) generally retains a constant volume.

Figure 12:
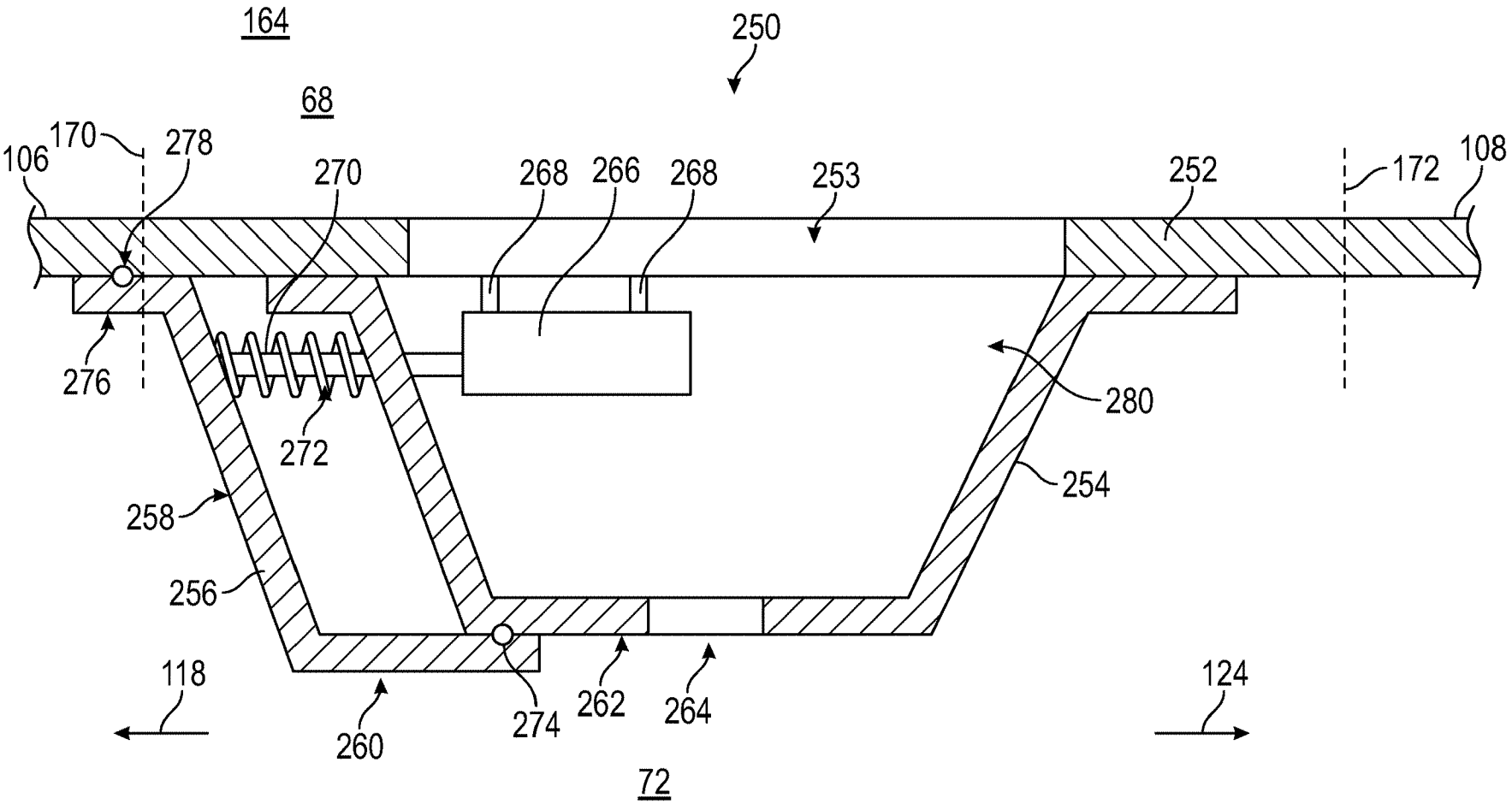
FIG. 12 is a partial cross-sectional side view of a combustor liner and a dilution liner section taken at detail view 164 of FIG. 2, according to still another aspect of the present disclosure.

FIG. 12 is a partial cross-sectional side view of a combustor liner and a dilution liner section taken at detail view 164 of FIG. 2, according to yet another aspect of the present disclosure. In FIG. 12, a dilution liner section 250 is depicted that is somewhat similar to the dilution liner section 234 of FIG. 11 in that the dilution liner section 250 includes a single liner where the upstream liner section 106 and the downstream liner section 108 are connected via a dilution liner 252. The dilution liner 252 may be similar to the dilution liner 168, except that, the dilution liner 252 includes a dilution opening 253 rather than a slotted opening 180. In addition, the aspect of FIG. 12 includes a fixed converging-diverging member 254 that is connected to the dilution liner 252 and/or the downstream liner section 108, and that includes a dilution opening 264 through a transition portion 262 of the fixed converging-diverging member 254. Similar to the aspect of FIG. 11, the dilution liner section 250 includes a movable portion 256 that has a converging portion 258 and a transition portion 260. The transition portion 260 of the movable portion 256 engages with the transition portion 262 of the fixed converging-diverging member 254 with a seal 274 therebetween. An upstream end 276 of the movable portion 256 engages with the upstream liner section 106 with a seal 278 therebetween.

An actuator 266 may be mounted to the dilution liner 252 via actuator support members 268. In FIG. 12, the actuator 266 is shown as being arranged within a cavity 280 defined by the fixed converging-diverging member 254 rather than being arranged within the outer flow passage 68 as the actuator 96 is depicted in FIG. 11. The actuator 266 includes a linkage 270 that is connected to the movable portion 256, and a spring-like device 272 may also be included. Thus, similar to the FIG. 11 aspect, the actuator 266 can translate the movable portion 256 in the upstream direction 118 to reduce the size of the primary volume (PV), and can translate the movable portion 256 in the downstream direction 124 to increase the size of the primary volume. Similar to the FIG. 11 aspect, the secondary volume (SV) remains constant due to the inclusion of the fixed converging-diverging member 254.

Figure 13:
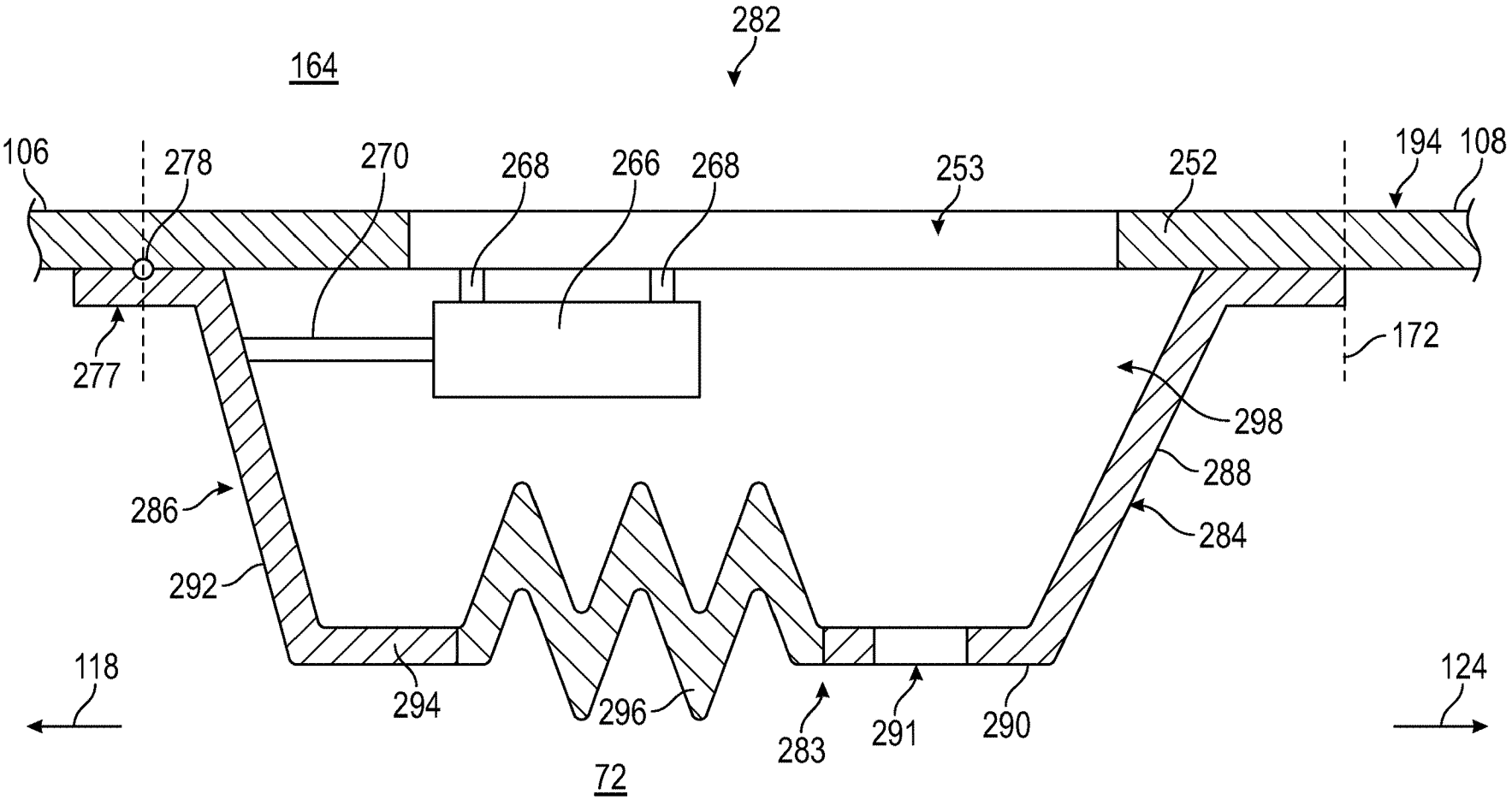
FIG. 13 is a partial cross-sectional side view of a combustor liner and a dilution liner section taken at detail view 164 of FIG. 2, according to yet another aspect of the present disclosure.

FIG. 13 is a partial cross-sectional side view of a combustor liner and a dilution liner section taken at detail view 164 of FIG. 2, according to still another aspect of the present disclosure. In FIG. 13, a dilution liner section 282, that may be referred to as a breathing dilution liner section, is depicted. Similar to FIG. 12, a single liner is provided in which the upstream liner section 106 and the downstream liner section 108 are connected by the dilution liner 252, which includes the dilution opening 253 therethrough. A converging-diverging member 283 includes a fixed diverging member 284 that is fixedly mounted to the dilution liner 252 and/or the upstream end 194 of the downstream liner section 108. The fixed diverging member 284 includes a diverging portion 288 and a transition portion 290 that includes a dilution opening 291 therethrough. The converging-diverging member 283 also includes a converging member 286 that is a movable portion of the converging-diverging member 283. The converging member 286 has a converging portion 292 and a transition portion 294. An upstream end 277 of the converging portion 292 slidingly engages with the upstream liner section 106 with a seal 278 therebetween. A bellows portion 296 is provided in the converging-diverging member 283 to connect the transition portion 294 of the converging member 286 to the transition portion 290 of the diverging member 284. Similar to the arrangement of FIG. 11, the actuator 266 is mounted to the dilution liner 252 via the actuator support members 268 within a cavity 298, and the linkage 270 is connected with the converging member 286. Thus, the actuator 266 can be actuated to translate the converging member 286 (i.e., the movable portion) in the upstream direction 118 so as to reduce the size of the primary volume (PV), and, consequently, to increase a volume of the cavity 298. Alternatively, the actuator 266 can be actuated to translate the converging member 286 in the downstream direction 124 so as to increase the size of the primary volume (PV) and, consequently, to decrease the volume of the cavity 298.

Figure 14:
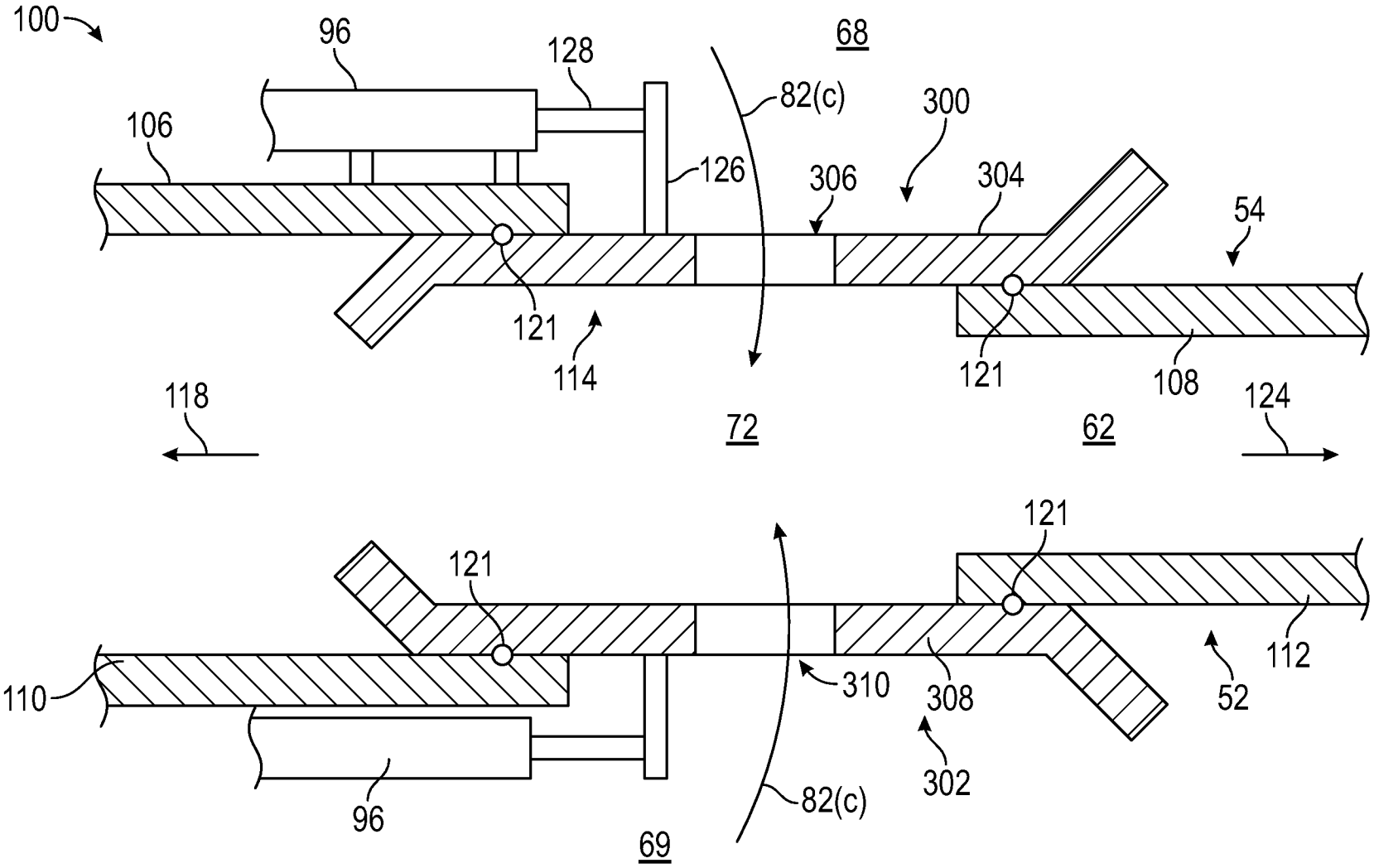
FIG. 14 is a partial cross-sectional side view of a combustor liner and a dilution liner section taken at detail view 100 of FIG. 2, according to still yet another aspect of the present disclosure.

FIG. 14 is a partial cross-sectional side view of a combustor liner and a dilution liner section taken at detail view 100 of FIG. 2, according to still yet another aspect of the present disclosure. In each of the forgoing arrangements in FIGS. 2 to 13, a converging-diverging section is described for implementing the dilution liner section of the combustor liner 50 so as to adjust the volume of the primary combustion zone 70 both structurally and aerodynamically. However, in the FIG. 14 arrangement, the dilution liner section is implemented as a straight section instead of a converging-diverging section and provides for adjusting the primary volume aerodynamically. In FIG. 14, the outer liner 54 is seen to include the upstream liner section 106 and the downstream liner section 108 with the gap 114 therebetween, and a dilution liner section 300 extends across the gap 114 so as to connect with the upstream liner section 106 and the downstream liner section 108. Similarly, the inner liner 52 is seen to include the upstream liner section 110 and the downstream liner section 112 with the gap 116 therebetween, and a dilution liner section 302 extends across the gap 116 so as to connect with the upstream liner section 110 and the downstream liner section 112. The dilution liner section 300 of the outer liner 54 includes a movable portion 304 that has at least one dilution opening 306 therethrough. The movable portion 304 includes the actuator connecting member 126 that is connected to the linkage 128 of the actuator 96. Thus, the actuator 96 can, based on the operating state, translate the movable portion 304 in either the upstream direction 118 or the downstream direction 124. By translating the movable portion 304 in the upstream direction 118, the dilution opening 306 translates upstream so as to aerodynamically reduce the primary volume. On the other hand, by translating the movable portion 304 in the downstream direction 124, the dilution opening translates downstream so as to aerodynamically increase the primary volume. Similar operations occur by the actuator 96 translating a movable portion 308 of the dilution liner section 302 in either the upstream direction 118 or in the downstream direction 124 so as to translate a dilution opening 310 either upstream or downstream. It should be noted that the movable portion 304 and the movable portion 308 can be actuated by their respective actuator 96 independent of one another so that, for example, the movable portion 304 may be translated in the upstream direction 118, while the movable portion 308 may not be translated, or may be translated in the upstream direction less than the movable portion 304. Of course, the movable portion 304 and the movable portion 308 may be translated the same amount and in the same direction.

Figure 15:
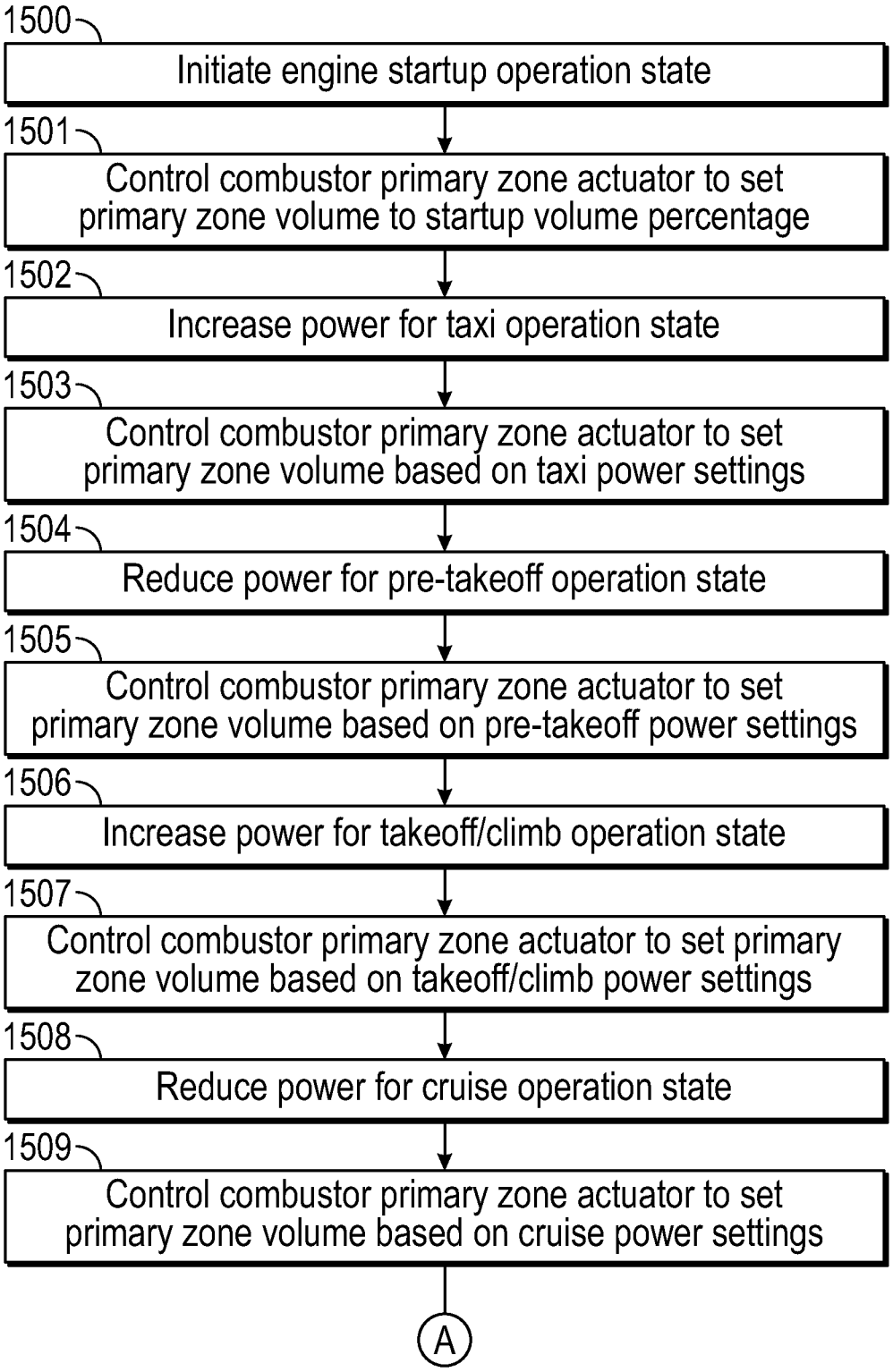
FIG. 15 is a flowchart of method steps for a method of operating a gas turbine, according to an aspect of the present disclosure.
Figure 15:
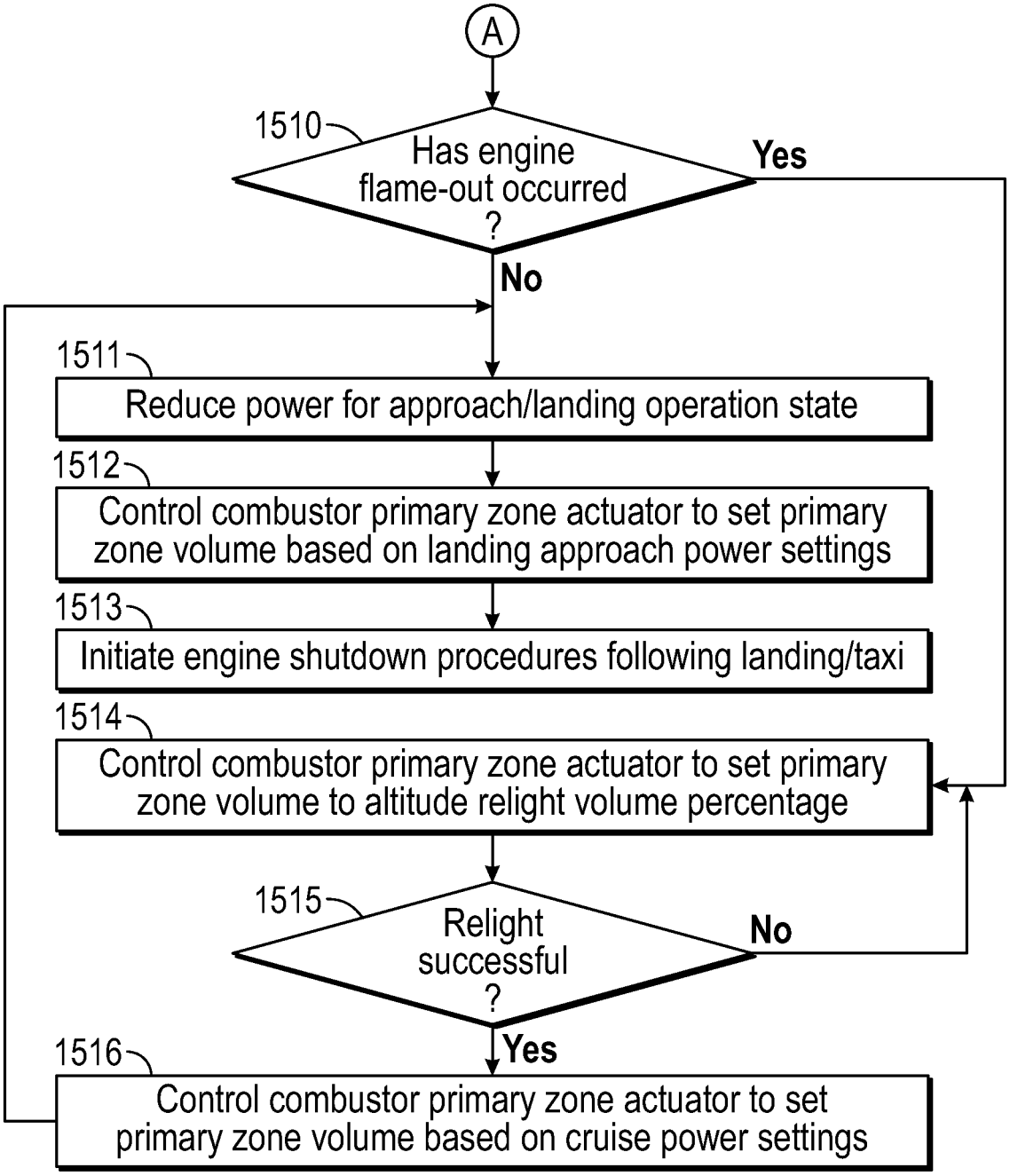

FIG. 15 is a flowchart depicting process steps for a method of operating the engine 10. The method of FIG. 15 may be implemented in any of the aspects depicted in FIGS. 1 to 14 as described above. In step 1500, an engine startup operation state is initiated to start the engine 10. An engine controller (e.g., a flight controller of an aircraft, not shown in the drawings) controls the engine startup operation, and, in step 1501, sends control signals to the actuator (e.g., any of the actuators 96, 132, 202, 212 and 266 described above) to adjust the size of the primary volume (PV) of the primary combustion zone 70 based on the startup operation power. The primary volume (PV) is adjusted based on controlling any of the dilution liner sections described above. For the ground startup operation, the primary volume may be referred to as a primary volume ($PV_1$) and may be adjusted and set to have a range from forty percent to sixty percent of the total volume ($V_T$). In step 1502, the engine power is increased for a taxiing operation prior to takeoff, and, in step 1503, the primary volume for the taxiing operation, which may be referred to as a primary volume ($PV_{1a}$), is adjusted based on power changes during the taxiing operation. Typically, prior to takeoff, the engine power may be reduced while the flight crew prepares for takeoff, and, in this case, in step 1504, the engine power may be reduced to an idle state that is similar to the ground startup state. As such, in step 1505, the controller sends signals to the actuator to adjust the primary volume to an idle state primary volume, which may be referred to as a primary volume ($PV_{1b}$), based on the idle power state.

Next, in step 1506, the engine power is increased for takeoff and a climb out operation, and, in step 1507, the controller sends signals to the actuator to adjust the primary volume (PV) for takeoff and climb out. The primary volume for the takeoff and climb out operation state, which may be referred to as a primary volume ($PV_2$), may have a range from thirty percent to forty percent of the total volume ($V_T$). Once a cruising altitude is reached, the engine power is typically reduced in step 1508, and, in step 1509, the controller sends signals to the actuator to adjust the primary volume (PV) based on the engine power during cruise. The size of the primary volume during the cruise operation, which may be referred to as a primary volume ($PV_3$), may be adjusted to a range of thirty percent to fifty percent of the total volume ($V_T$).

During the cruise operating state, or at any other operating state, an engine flame-out may occur. When an engine flame-out has occurred during the cruise operating state (YES, in 1510), a high altitude relight operating condition is initiated. In this case, at step 1514, the controller sends signals to the actuators to adjust the primary volume to a relight operation primary volume, which may be referred to as a primary volume ($PV_5$), for a high altitude relight operating state. As is well known, signals are also sent to others of the various engine components, such as the fuel nozzle, the ignitor, etc. to perform the relight operation, but those are not discussed herein. At step 1515, if it is determined that the relight operation is successful (YES in step 1515), then, in step 1516, the controller again sends signals to the actuator to adjust the primary volume size to the primary volume ($PV_3$) for the cruise operating state.

At the end of the cruise operations, a landing approach operation state is commenced at step 1511 in which the engine power is typically reduced. In step 1512, the controller sends signals to the actuators to adjust the primary volume to an approach primary volume, which may be referred to as a primary volume ($PV_4$) for the approach operation state and the landing operation state. In the approach/landing operation state, the primary volume ($PV_4$) may be adjusted to a range of thirty percent to fifty percent of the total volume $V_T$. Finally, after landing and a taxiing operation, an engine shutdown sequence is initiated in step 1513.

While the foregoing description relates generally to a gas turbine engine, it can readily be understood that the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects of the present disclosure are provided by the subject matter of the following clauses.

A method of operating a combustor of a gas turbine, the combustor including a combustor liner defining a combustion chamber therewithin that defines a total combustion chamber volume, the combustion chamber including a primary combustion zone at an upstream end of the combustion chamber that defines a primary volume, the combustor liner including a movable portion that is arranged to be actuated to adjust a percentage of the primary volume with respect to the total combustion chamber volume, the method comprising, at a first operating state of the gas turbine, adjusting a size of the primary volume to a first percentage of the total combustion chamber volume by actuating the movable portion to adjust the size of the primary volume, and at a second operating state of the gas turbine different from the first operating state, adjusting the size of the primary volume to a second percentage of the total combustion chamber volume by actuating the movable portion to adjust the size of the primary volume.

The method according to the preceding clause, wherein the first operating state is a ground start state and the second operating state is a takeoff or a climb state.

The method according to any preceding clause, wherein the movable portion comprises at least one dilution opening therethrough, and the percentage of the primary volume is aerodynamically adjusted by translation of a flow of dilution oxidizer through the dilution opening in an upstream direction of the flow and in a downstream direction of the flow.

The method according to any preceding clause, wherein the combustor liner is an annular liner and includes an outer liner and an inner liner with the combustion chamber defined therebetween, and both the outer liner and the inner liner include respective movable portions to adjust the primary volume.

The method according to any preceding clause, wherein the movable portion is actuated by an actuator responsive to changes in power percentages applied to the gas turbine through a plurality of operating states, including the first operating state and the second operating state.

The method according to any preceding clause, wherein the first percentage has a range from forty percent to sixty percent of the total combustion chamber volume.

The method according to any preceding clause, wherein the second percentage has a range from thirty percent to forty percent of the total combustion chamber volume.

The method according to any preceding clause, further comprising, at a third operating state of the gas turbine different from the first operating state and the second operating state, adjusting the size of the primary volume to a third percentage of the total combustion chamber volume by actuating the movable portion to adjust the size of the primary volume.

The method according to any preceding clause, wherein the third operating state is a cruise state.

The method according to any preceding clause, wherein the third percentage has a range from thirty percent to fifty percent of the total combustion chamber volume.

The method according to any preceding clause, further comprising, at a fourth operating state of the gas turbine different from the first operating state, the second operating state, and the third operating state, adjusting the size of the primary volume to a fourth percentage of the total combustion chamber volume by actuating the movable portion to adjust the size of the primary volume.

The method according to any preceding clause, wherein the fourth operating state is an approach state.

The method according to any preceding clause, wherein the fourth percentage has a range from thirty percent to fifty percent of the total combustion chamber volume.

The method according to any preceding clause, further comprising, at a fifth operating state of the gas turbine different from the first operating state, the second operating state, the third operating state, and the fourth operating state, adjusting the size of the primary volume to a fifth percentage of the total combustion chamber volume by actuating the movable portion to adjust the size of the primary volume.

The method according to any preceding clause, wherein the fifth operating state is an altitude relight state, and the fifth percentage has a range from forty percent to seventy percent of the total combustion chamber volume.

The method according to any preceding clause, wherein the movable portion of the combustor liner comprises a converging-diverging portion extending into the combustion chamber and having at least one dilution opening therethrough, the converging-diverging portion being arranged in a dilution zone of the combustion chamber downstream of the primary combustion zone.

The method according to any preceding clause, wherein the combustor liner comprises an upstream liner section fixedly mounted in the combustor and a downstream liner section fixedly mounted in the combustor with a gap between the upstream liner section and the downstream liner section, the converging-diverging portion extending across the gap and engaging with the upstream liner section and the downstream liner section.

The method according to any preceding clause, wherein the percentage of the primary volume is aerodynamically and/or structurally adjusted by translation of the converging-diverging portion and a flow of dilution oxidizer through the dilution opening in an upstream direction and in a downstream direction.

The method according to any preceding clause, further comprising, at a third operating state of the gas turbine different from the first operating state and the second operating state, adjusting the size of the primary volume to a third percentage of the total combustion chamber volume by actuating the movable portion to adjust the size of the primary volume, and at a fourth operating state of the gas turbine different from the first operating state, the second operating state, and the third operating state, adjusting the size of the primary volume to a fourth percentage of the total combustion chamber volume by actuating the movable portion to adjust the size of the primary volume, wherein the first percentage has a range from forty percent to sixty percent of the total combustion chamber volume, the second percentage has a range from thirty percent to forty percent of the total combustion chamber volume, the third percentage has a range from thirty percent to fifty percent of the total combustion chamber volume, and the fourth percentage has a range from thirty percent to fifty percent of the total combustion chamber volume.

The method according to any preceding clause, wherein the first operating state is a ground start state or an altitude relight state, the second operating state is a takeoff state or a climb state, the third operating state is a cruise state, and the fourth operating state is an approach state.

Although the foregoing description is directed to some exemplary embodiments of the present disclosure, it is noted that other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A method of operating a combustor of a gas turbine, the combustor including a combustor liner defining a combustion chamber therewithin that defines a total combustion chamber volume, the combustion chamber including a primary combustion zone at an upstream end of the combustion chamber that defines a primary volume, the combustor liner including a movable portion that is arranged to be actuated to adjust a percentage of the primary volume with respect to the total combustion chamber volume, the method comprising:

at a first operating state of the gas turbine, adjusting a size of the primary volume to a first percentage of the total combustion chamber volume by actuating the movable portion to adjust the size of the primary volume; and at a second operating state of the gas turbine different from the first operating state, adjusting the size of the primary volume to a second percentage of the total combustion chamber volume by actuating the movable portion to adjust the size of the primary volume, wherein the combustor liner is an annular liner and includes an outer liner and an inner liner with the combustion chamber defined therebetween, and both the outer liner and the inner liner include respective movable portions to adjust the primary volume.

2. The method according to claim 1, wherein the first operating state is a ground start state and the second operating state is a takeoff state or a climb state.

3. The method according to claim 1, wherein the respective movable portions comprise at least one dilution opening therethrough, and the percentage of the primary volume is aerodynamically adjusted by translation of a flow of dilution oxidizer through the dilution opening in an upstream direction of the flow and in a downstream direction of the flow.

4. The method according to claim 1, wherein the respective movable portions are actuated by a respective actuator responsive to changes in power percentages applied to the gas turbine through a plurality of operating states, including the first operating state and the second operating state.

5. The method according to claim 1, wherein the first percentage has a range from forty percent to sixty percent of the total combustion chamber volume.

6. The method according to claim 5, wherein the second percentage has a range from thirty percent to forty percent of the total combustion chamber volume.

7. The method according to claim 1, further comprising, at a third operating state of the gas turbine different from the first operating state and the second operating state, adjusting the size of the primary volume to a third percentage of the total combustion chamber volume by actuating the respective movable portions to adjust the size of the primary volume.

8. The method according to claim 7, wherein the third operating state is a cruise state.

9. The method according to claim 7, wherein the third percentage has a range from thirty percent to fifty percent of the total combustion chamber volume.

10. The method according to claim 7, further comprising, at a fourth operating state of the gas turbine different from the first operating state, the second operating state, and the third operating state, adjusting the size of the primary volume to a fourth percentage of the total combustion chamber volume by actuating the respective movable portions to adjust the size of the primary volume.

11. The method according to claim 10, wherein the fourth operating state is an approach state.

12. The method according to claim 10, wherein the fourth percentage has a range from thirty percent to fifty percent of the total combustion chamber volume.

13. The method according to claim 10, further comprising, at a fifth operating state of the gas turbine different from the first operating state, the second operating state, the third operating state, and the fourth operating state, adjusting the size of the primary volume to a fifth percentage of the total combustion chamber volume by actuating the respective movable portions to adjust the size of the primary volume.

14. The method according to claim 13, wherein the fifth operating state is an altitude relight state, and the fifth percentage has a range from forty percent to seventy percent of the total combustion chamber volume.

15. The method according to claim 1, wherein the respective movable portions of the combustor liner each comprise a converging-diverging portion extending into the combustion chamber and having at least one dilution opening therethrough, the converging-diverging portion being arranged in a dilution zone of the combustion chamber downstream of the primary combustion zone.

16. The method according to claim 15, wherein the combustor liner comprises an upstream liner section fixedly mounted in the combustor and a downstream liner section fixedly mounted in the combustor with a gap between the upstream liner section and the downstream liner section, the converging-diverging portion extending across the gap and engaging with the upstream liner section and the downstream liner section.

17. The method according to claim 16, wherein the percentage of the primary volume is aerodynamically and/or structurally adjusted by translation of the converging-diverging portion and a flow of dilution oxidizer through the dilution opening in an upstream direction and in a downstream direction.

18. The method according to claim 1, further comprising, at a third operating state of the gas turbine different from the first operating state and the second operating state, adjusting the size of the primary volume to a third percentage of the total combustion chamber volume by actuating the respective movable portions to adjust the size of the primary volume; and at a fourth operating state of the gas turbine different from the first operating state, the second operating state, and the third operating state, adjusting the size of the primary volume to a fourth percentage of the total combustion chamber volume by actuating the respective movable portions to adjust the size of the primary volume, wherein the first percentage has a range from forty percent to sixty percent of the total combustion chamber volume, the second percentage has a range from thirty percent to forty percent of the total combustion chamber volume, the third percentage has a range from thirty percent to fifty percent of the total combustion chamber volume, and the fourth percentage has a range from thirty percent to fifty percent of the total combustion chamber volume.

19. The method according to claim 18, wherein the first operating state is a ground start state or an altitude relight state, the second operating state is a takeoff state or a climb state, the third operating state is a cruise state, and the fourth operating state is an approach state.

* * * * *